US006840303B1

(12) United States Patent
Ohtani et al.

(10) Patent No.: US 6,840,303 B1
(45) Date of Patent: Jan. 11, 2005

(54) PROCESS FOR CONTINUOUSLY CASTING LIGHT ALLOY AND APPARATUS FOR CONTINUOUSLY CASTING LIGHT ALLOY

(75) Inventors: Teruyuki Ohtani; Nobuhiro Saito; Takeyoshi Nakamura, all of Wako; Takashi Idegomori, Sayama; Kiyonobu Mizoue, Sayama; Yoshiyuki Fujikawa, Sayama, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/266,870

(22) Filed: Mar. 12, 1999

(30) Foreign Application Priority Data

Mar. 13, 1998 (JP) ..... 10-063506
Jul. 1, 1998 (JP) ..... 10-186058
Sep. 10, 1998 (JP) ..... 10-256929

(51) Int. Cl.[7] ..... B22D 11/07; B22D 27/02
(52) U.S. Cl. ..... 164/472; 164/468; 164/504
(58) Field of Search ..... 164/468, 504, 164/487, 472

(56) References Cited

U.S. PATENT DOCUMENTS 4,157,728 A 6/1979 Mitamura et al. ..... 164/4
4,214,624 A * 7/1980 Foye et al. ..... 164/89
4,522,250 A * 6/1985 Laemmle et al. ..... 164/472
5,027,888 A * 7/1991 Sakaguchi et al. ..... 164/480
5,219,018 A * 6/1993 Meyer ..... 164/468

FOREIGN PATENT DOCUMENTS

| | | |
|---|---|---|
| AU | 264 739 | 12/1967 |
| DE | 10 67 571 | 10/1959 |
| DE | 33 38 185 | 5/1984 |
| EP | 0 372 946 | 6/1930 |
| EP | 0 218 855 | 4/1987 |
| EP | 0 337 769 | 10/1989 |

* cited by examiner

*Primary Examiner*—Tom Dunn
*Assistant Examiner*—Len Tran
(74) *Attorney, Agent, or Firm*—Arent Fox PLLC

(57) ABSTRACT

An ingot I made of a light alloy is produced using a continuous casting apparatus including a cylindrical water-cooled casting mold which is disposed immediately below a spout having an upward-turned molten metal receiving port and a downward-turned molten metal outlet, and which has an inside radius $r_1$ larger than an inside radius $r_2$ of the molten metal outlet, and lubricating oil discharge passages provided below the spout to supply a lubricating oil to between the water-cooled casting mold 13 and a molten metal m brought into contact with the water-cooled casting mold. In this production, a lubricating oil having a vaporization rate of 30% or more at 300° is used, and an annular gas accumulation for spacing the molten metal apart from outlets of the lubricating oil discharge passages is defined below an annular protrusion of the spout by vaporization of the lubricating oil. Thus, it is possible to avoid the generation of a casting skin failure in a light alloy ingot due to the outlets of the lubricating oil discharge passages.

6 Claims, 17 Drawing Sheets

PROCESS FOR CONTINUOUSLY CASTING LIGHT ALLOY AND APPARATUS FOR CONTINUOUSLY CASTING LIGHT ALLOY

BACKGROUND OF THE INVENTION

1. Field of the Invention

The present invention relates to a process for continuously casting a light alloy and to an apparatus for continuously casting a light alloy.

2. Description of the Related Art

A process for producing a light alloy ingot using a continuous casting apparatus which will be described below, is conventionally known as a process for continuously casting a light alloy (an aluminum alloy, a magnesium alloy or the like). The apparatus includes a cylindrical water-cooled casting mold which is disposed immediately below a spout having an upward-turned molten metal receiving port and a downward-turned molten metal outlet and which has an inside radius larger than that of the molten metal outlet, and a lubricating oil discharge passage provided below the spout to supply a lubricating oil to a portion between the water-cooled casting mold and the molten metal brought into contact with the water-cooled casting mold. In this case, a plurality of lubricating oil discharge passages are generally disposed in a circumferential direction of the water-cooled casting mold.

However, the above process suffers from the following problem: When the molten metal exits from the spout and flows downwards within the water-cooled casting mold, such a phenomenon occurs that just a small amount of an outer-circumferential portion of the molten metal enters outlets of some of the discharge passages, and then exits from each of the outlets and flows along an inner peripheral surface of the water-cooled casting mold. Due to this, an outer peripheral surface of a produced ingot is torn off, roughened as a casting skin and the like to provide a casting skin failure. This will further become noticeable, if a circumferential electromagnetic agitating force is applied to the molten metal.

On the other hand, the dynamic viscosity of the lubricating oil is varied remarkably depending on the temperature and cannot be constant in each of the discharge passages. For this reason, a difference between discharge resistances to the lubricating oil in the discharge passages is produced and as a result, the amount of lubricating oil fed out of each of the discharge passages is liable to be non-uniform. This also causes the casting skin failure.

There is also a conventionally known continuous casting apparatus which includes a cylindrical water-cooled casting mold having a vertically-turned axis, and a lubricating oil supply passageway having a plurality of discharge ports disposed in the vicinity of an annular upper end of the cylindrical water-cooled casting mold. In this case, each of the discharge ports has a predetermined length in a direction of discharging of a lubricating oil, and the amount of lubricating oil discharged is controlled by constricting each of the discharge ports.

When a molten metal is continuously supplied to the cylindrical water-cooled casting mold from above the casting mold, a non-solidified portion of the molten metal is intermittently converted into a solidified portion in an upper portion of the cylindrical water-cooled casting mold. For this reason, a vibration is produced in the pressure of the molten metal. If the amount of lubricating oil discharged is controlled in the discharge ports under such a situation, the following problem occurs: the vibration of the molten metal pressure is applied directly to the discharge ports, thereby casing the entering of the molten metal into the discharge ports and the attendant back flow of the lubricating oil. As a result, the lubricating oil is not uniformly discharged from each of the discharge ports, whereby the roughening of a casting skin of a produced ingot is produced. In an extreme case, a phenomenon that the solidified portion of the outer periphery of the ingot is broken to cause the non-solidified portion within the solidified portion to be leaked outside, namely, a situation that a break-out is generated to fail the casting, is brought about.

This problem is further noticeable, when the agitating force is applied to the molten metal, because a vibration attendant on the agitating force is added to the above-described vibration.

SUMMARY OF THE INVENTION

Accordingly, it is an object of the present invention to provide a continuous casting process of the above-described type, wherein the generation of a casting skin failure of a light alloy ingot due to the outlets of the lubricating oil discharge passages can be avoided by employing a relatively simple means.

To achieve the above object, according to a first aspect and feature of the present invention, there is provided a continuous casting process for continuously casting a light alloy for producing an ingot made of a light alloy by using a continuous casting apparatus comprising a cylindrical water-cooled casting mold which is disposed immediately below a spout having an upward-turned molten metal receiving port and a downward-turned molten metal outlet and which has an inside radius larger than an inside radius of the molten metal outlet, and lubricating oil discharge passages provided below the spout to supply a lubricating oil to a portion between the water-cooled casting mold and the molten metal brought into contact with the water-cooled casting mold, wherein the lubricating oil is an oil having a vaporization rate of 30% or more at 300° C., and an annular gas accumulation for spacing the molten metal apart from outlets of the lubricating oil discharge passages is defined below an annular protrusion of the spout.

With the above continuous casting process, the entering of the molten metal into the outlet can be inhibited by the annular gas accumulation and hence, the generation of a casting skin failure due to the outlet can be avoided. The lubricating oil which has not been vaporized lubricates the portion between the water-cooled casting mold and the molten metal.

In this case, the vaporization rate of the lubricating oil at 300° C. may be 100%. The reason is that the gas in a lower end of the gas accumulation is cooled and liquefied by the water-cooled casting mold, and the liquefied lubricating oil contributes to the lubrication between the water-cooled casting mold and the molten metal. However, if the vaporization rate of the lubricating oil at 300° C. is lower than 30%, it is impossible to form a gas accumulation having a pressure enough to space the molten metal apart from the outlet.

The gas accumulation exhibits the function to inhibit the entering of the molten metal into the outlet even in the continuous casting process in which a circumferential electromagnetic agitating force is applied to the molten metal.

In the above-described continuous casting process, it is desirable that a lubricating agent mixture of a lubricating oil and a solid lubricating agent is used. Thus, it is possible to prevent the lubrication between the water-cooled casting mold and the molten metal from becoming insufficient in response to vaporization of the lubricating oil. In this case, the amount A of solid lubricating agent mixed is set in a range of 1% by weight≦A≦10% by weight. If the amount A is lower than 1% by weight, the use of the solid lubricating agent is meaningless. On the other hand, if A<10% by weight, the amount of the solid lubricating agent is excessive, thereby causing an oil-baking on an outer peripheral surface of an ingot.

Further, the dynamic viscosity v of the lubricating oil in an inlet of each of the lubricating oil discharge passages may be set in a range of v≦30 $mm^2$/sec. If the dynamic viscosity v is set in such range, the variation in viscosity attendant on a variation in temperature of the lubricating oil can be reduced extremely to uniformize the amount of lubricating oil distributed from each of the discharge passages. However, if the dynamic viscosity v is higher than 30 $mm^2$/sec., a casting skin failure of an ingot is liable to be produced.

It is another object of the present invention to provide a continuous casting apparatus of the above-described type, wherein the above-described continuous casting process can be carried out.

To achieve the above object, according to a second aspect and feature of the present invention, there is provided a continuous casting apparatus for continuously casting a light alloy, comprising a spout having an upward-turned molten metal receiving port and a downward-turned molten metal outlet, a cylindrical water-cooled casting mold which is disposed immediately below the spout to cool a molten metal from the molten metal outlet and which has an inside radius $r_1$ larger than an inside radius $r_2$ of the molten metal outlet, an agitator for applying a circumferential electromagnetic agitating force to the molten metal, lubricating oil discharge passages provided between an annular lower end face of the spout and an annular upper end face of the water-cooled casting mold to supply a lubricating oil to a portion between the water-cooled casting mold and the molten metal brought into contact with the water-cooled casting mold, and a coating layer which is provided on the annular upper end face and which has a heat conductivity coefficient lower than that of the water-cooled casting mold.

With the apparatus, the dropping of the temperature of the lubricating oil by the water-cooled casting mold can be inhibited in accordance with the coating layer, thereby promoting the vaporization of the lubricating oil to achieve the intended object.

In the apparatus, the lubricating oil discharge passages can be defined by a discharge passage defining plate. In this case, the discharge passage defining plate is formed from a material having a heat conductivity coefficient lower than that of the water-cooled casting mold to promote the vaporization rate of the lubricating oil.

The apparatus includes a lubricating oil supply passageway which includes the discharge passages, that portion of the lubricating oil supply passageway which is connected to the discharge passages being disposed around the spout. With the arrangement, the lubricating oil can be heated by the spout, whereby the dynamic viscosity of the lubricating oil can be stabilized.

Further, the apparatus may includes a lubricating oil heating heater disposed in the vicinity of inlets of the discharge passages. With the arrangement, the lubricating oil can be heated by the heater, whereby the dynamic viscosity of the lubricating oil can be stabilized, as described above.

It is a further object of the present invention to provide a continuous casting apparatus of the above-described type, wherein the lubricating oil can be uniformly discharged from each of the discharge ports.

To achieve the above object, according to a third aspect and feature of the present invention, there is provided a continuous casting apparatus, comprising a cylindrical water-cooled casting mold having a vertically-turned axis, and a supply passageway for supplying a lubricating oil to an inner peripheral surf ace side of the cylindrical water-cooled casting mold, the supply passageway including a plurality of discharge ports disposed in the vicinity of an annular upper end of the cylindrical water-cooled casting mold, and a plurality of distributing passages for distributing the lubricating oil to the discharge ports and having constrictions, the length L of each of the discharge ports in an ingot-withdrawing direction being set at a value enough to avoid the generation of a break-out, the relationship between a sum $A_1$ of sectional areas of all the discharge ports and a sum $A_2$ of sectional areas of all the constrictions being determined to ensure $A_1>A_2$, the ratio $A_2/A_1$ of both the sums $A_1$ and $A_2$ of the sectional areas being in a range $$Lmin/L \leqq A_2/A_1 \leqq 1-(1/Fmax)F$$

wherein Lmin is a minimum value of the length of the discharge port in the ingot-withdrawing direction, which is enough to discharge the lubricating oil; F is a frequency for the vibration of a molten metal pressure applied to the discharge port, and assumes a value $f_1$, when the molten metal is not agitated, and assumes a value $(f_1+f_2)$ resulting from addition of an agitation frequency $f_2$ to the value $f_1$, when the molten metal is agitated; and Fmax is a frequency for the vibration of the molten metal pressure applied to the discharge port, when the ratio $A_2/A_1$ is equal to 0.

With the above arrangement, when the vibration of the molten metal is applied to each of the discharge ports, the internal pressure in each of the discharge ports rises due to the presence of the constrictions. Therefore, the entering of the molten metal into each of the discharge ports and the attendant back flow of the lubricating oil are prevented. In addition, the vibration of the molten metal cannot be applied directly to each of the constrictions and hence, an amount of the lubricating oil controlled by each of the constructions is uniformly discharged from each of the discharge ports. Thus, it is possible to prevent the roughening of a casting skin of an ingot, the generation of a break-out, and the like.

However, if the ratio $A_2/A_1$ is smaller than Lmin/L, or larger than 1−(1/Fmax), a defect such as the roughening of a casting skin of an ingot and the like are produced.

The above and other objects, features and advantages of the invention will become apparent from the following description of the preferred embodiments taken in conjunction with the accompanying drawings.

DETAILED DESCRIPTION OF THE PREFERRED EMBODIMENTS

[Embodiment I (FIGS. 1 to 13)]

Figure 1:
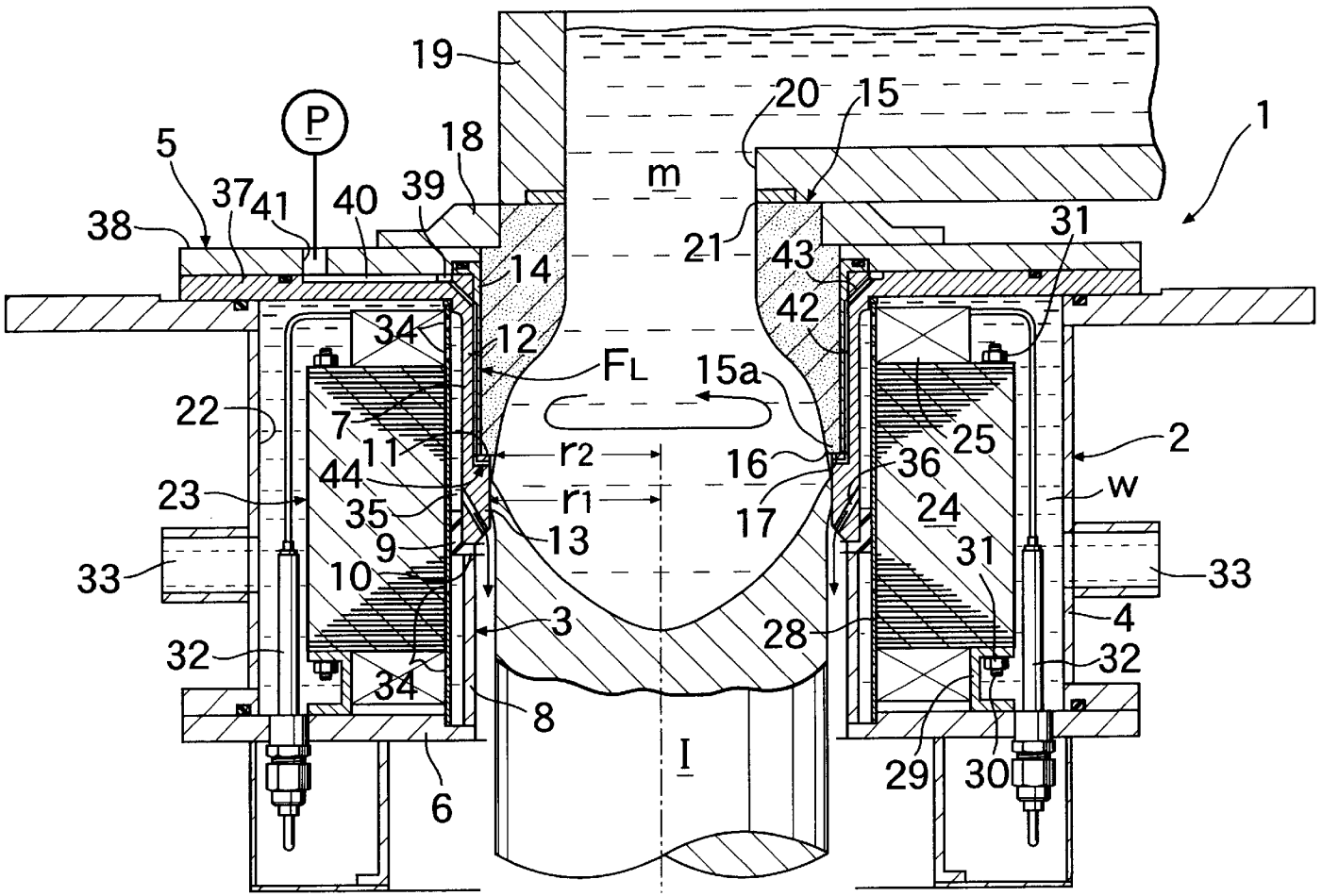
FIG. 1 is a vertical sectional view of a continuous casting apparatus according to a first embodiment of the present invention.
Figure 2:
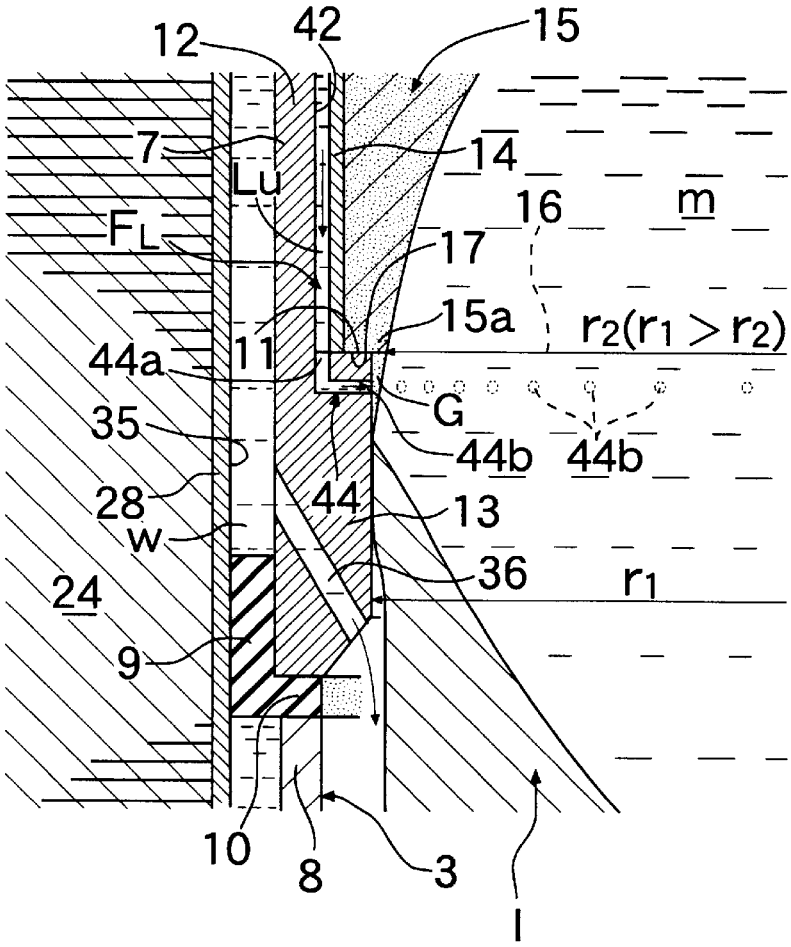
FIG. 2 is an enlarged view of an essential portion of the apparatus shown in FIG. 1.

A first embodiment of a hot-top type continuous casting apparatus 1 shown in FIGS. 1 and 2 includes a drum-shaped body 2 having an axis turned vertically. The drum-shaped body 2 is comprised of an inner peripheral wall 3, an outer peripheral wall 4 disposed at a predetermined distance around the outer periphery of the inner peripheral wall 3, an annular upper end wall 5 located at upper ends of both the walls 3 and 4, and an annular lower end wall 6 located at lower ends of both the walls 3 and 4.

The inner peripheral wall 3 comprises an upper cylindrical portion 7 and a lower cylindrical portion 8. An inward-turned annular portion 10 of an annular rubber seal 9 fitted over an outer peripheral surface of a lower portion of the upper cylindrical portion 7 is interposed between both the cylindrical portions 7 and 8 to seal a section between both the cylindrical portions 7 and 8. A lower half of the upper cylindrical portion 7 is formed at a thickness larger than that of an upper half, so that an annular step is formed inside the lower half, thereby forming a cylindrical water-cooled casting mold 13. Therefore, the cylindrical water-cooled casting mold 13 has a cylindrical portion 12 comprised of the upper half, and an annular upper end face 11 comprised of the annular step. The cylindrical water-cooled casting mold 13 is formed of an aluminum alloy (e.g., A5052).

The cylindrical portion 12 surrounds a spout 15 with a thin cylindrical member 14 interposed therebetween, and an annular lower end face 17 defining a downward-turned molten metal outlet 16 of the spout 15 abuts against the annular upper end face 11 of the water-cooled casting mold 13. An annular removal-preventing plate 18 is fitted over a portion of the spout 15, which protrudes from the upper end wall 5. The removal-preventing plate 18 is fixed to the upper end wall 5. The spout 15 is formed of calcium silicate having a heat-insulating property and a fire resistance. Alternatively, alumina, silica or the like may be used as a material for forming the spout 15. The water-cooled casting mold 13 has an inside radius $r_1$ set larger than an inside radius $r_2$ at the molten metal outlet 16 of the spout 15. Therefore, a portion around the molten metal outlet 16 of the spout 15 presents an annular protrusion 15*a*.

A molten metal tub 19 for horizontal pouring of a molten metal is disposed above the spout 15 and has a downward-turned molten metal supply port 20 which communicates with an upward-turned molten metal receiving port 21 of the spout 15.

Figure 3:
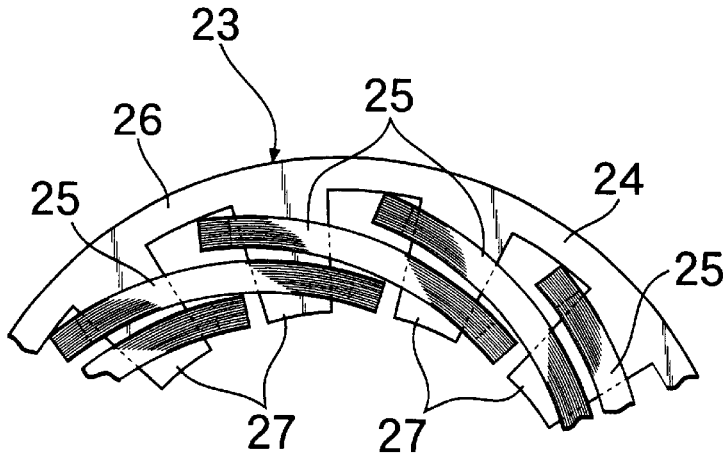
FIG. 3 is a plan view of an essential portion showing the relationship between a stratified iron core and coils.

An electromagnetic induction-type agitator 23 is disposed in a cylindrical closed space 22 between the inner and outer peripheral walls 3 and 4 of the drum-shaped body 2 and applies a circumferential electromagnetic agitating force to the molten metal m within the spout 15. The agitator 23 comprises a cylindrical stratified iron core 24 and a plurality of coils 25 wound around the stratified iron core 24. The stratified iron core 24 is comprised of a cylindrical portion 26, and a plurality of projections 27 disposed at circumferentially equal distances around an inner peripheral surface of the cylindrical portion 26 and extending along a generatrix line, as best shown in FIG. 3. Each of the coils 25 is wound around the adjacent projections 27, so that portions of two coils 25 are overlapped on each other at one projection 27.

A thin cylindrical coil-retaining member 28 is fitted inside the stratified iron core 24, so that tip end faces of the projections 27 are in close contact with the coil-retaining member 28. The cylindrical member 28 is fixed within the cylindrical closed space 22 with a portion of its inner peripheral surface in close contact with the annular rubber seal 9. The stratified iron core 24 is placed on to an annular support member 29 and fixed to the support member 29 by a plurality of bolts 30 and nuts 31. A plurality of connectors 32 are prepared two for one coil 25 and mounted through the lower end wall 6 by a-water-tight means.

A plurality of water supply ports 33 are defined in the outer peripheral wall 4, so that cooling water w is supplied through each of the water supply ports 33 into the closed space 22. A plurality of through-bores 34 are defined in the cylindrical member 28 inside the stratified iron core 24 and located in the vicinity of an upper end of the cylindrical member 28 and thus, a cooling water sump 35 is provided above the annular rubber seal 9. The water-cooled casting mold 13 is cooled by means of the cooling water sump 35, and has a plurality of ejection bores 36 for ejecting the cooling water win the cooling water sump 35 obliquely and downwards.

In order to supply a lubricating oil to between the water-cooled casting mold 13 and the molten metal m, a lubricating oil supply passageway $F_L$ which will be described below is provided around the spout 15. A lower plate 37 of the upper end wall 5 is integrally provided at an upper end of the upper cylindrical portion 7 of the inner peripheral wall 3. Provided between an upper plate 38 and the lower plate 37 of the upper end wall 5 are an annular passage 39 surrounding the spout 15, and a plurality of straight passages 40 extending radiately from the annular passage 39. An introducing passage 41 defined in the upper plate 38 communicates with ends of the straight passages 40, and is connected to an oil supply pump P. As best shown in FIG. 2, a cylindrical passage 42 is defined around the spout 15, e.g., between an outer peripheral surface of the cylindrical member 14 and an inner peripheral surface of the cylindrical portion 12 in the illustrated embodiment, and a plurality of obliquely-turned through-bores 43 are defined in a connection between the cylindrical portion 12 and the lower plate 37 to permit the communication between the cylindrical passage 42 and the annular passage 39. A lower end of the cylindrical passage 42 communicates with a plurality of discharge passages 44 defined at circumferentially equal distances in the water-cooled casting mold 13. Each of the discharge passages 44 is of an L-shape, and has an inlet 44*a* which is located at a tip end of a vertical portion of each discharge passage 44 and which opens into the annular upper end face 11 to communicate with the cylindrical passage 42, and an outlet 44*b* which is located at a tip end of a horizontal portion of each discharge passage 44 and which opens into an inner peripheral surface. In this way, the lubricating oil supply passageway $F_L$ is comprised of the introducing passage 41, the straight passages 40, the annular passage 39, the through-bores 43, the cylindrical passage (the portion connected to the discharge passages 44 and the discharge passages 44.

An oil having a vaporization rate of 30% or more at 300° C., e.g., Terasu oil #46, #32 or #22 (which is a trade name and is commercially available from Showa Shell Co.) is commonly used alone as the lubricating oil Lu. Another lubrication oil may be mixed with this oil. A solid lubricating agent which is mixed into the lubricating oil Lu to form a lubricating agent mixture, which may be used, is a PTFE powder, a graphite powder, a BN powder, a molybdenum powder (e.g., a molybdenum disulfide) or the like. The amount A of solid lubricating agent mixed is set in a range of 1% by weight$\leqq$A$\leqq$10% by weight.

In the above-described arrangement, when the molten metal m comprising, for example, an aluminum alloy is supplied from the molten metal supply port 20 of the molten metal supply tub 19 into the spout 15, an electromagnetic agitating force is applied to the molten metal m in the spout 15 by the agitator 23, and the molten metal m is then cooled by the water-cooled casting mold 13 to provide an ingot I.

In this casting course, the lubricating oil Lu, while is flowing in the cylindrical passage 42, is heated by the spout 15, e.g., the cylindrical member 14 which has received a heat transferred from the spout 15 in the illustrated embodiment, so that the dynamic viscosity is stabilized, whereby the amount of lubricating oil delivered from each of the discharge passages 44 is equalized. The temperature of the molten metal m existing in the vicinity of the outlet 44*b* of each of the lubricating oil discharge passages 44 is in a range of 300 to 400° C. and hence, the lubricating oil Lu existing in the outlet 44*b* and in the vicinity of the outlet 44*b* is further heated by the molten metal m, whereby 30% or more of the lubricating oil Lu is vaporized. Thus, an annular gas accumulation G for spacing the molten metal m from each of the outlets 44*b* is formed below the annular protrusion 15*a* of the spout 15.

With such continuous casting process, the entering of the molten metal m into each of the outlets 44*b* can be inhibited by the annular gas accumulation G and hence, the generation of a casting skin failure in an outer peripheral surface of the ingot I due to the outlets 44*b* can be avoided. The unvaporized lubricating oil Lu and/or the solid lubricating agent lubricate an area between the water-cooled casting mold 13 and the molten metal m.

The annular gas accumulation G is formed even when an electromagnetic agitation as described above is provided. Therefore, the annular gas accumulation G is, of course, formed even in a usual continuous casting process in which the electromagnetic agitation is not provided. The spheroidization of the crystallized products having a high melting point is conducted by the electromagnetic agitation and hence, an ingot I optimal for a thixocasting process can be obtained.

Figure 4:
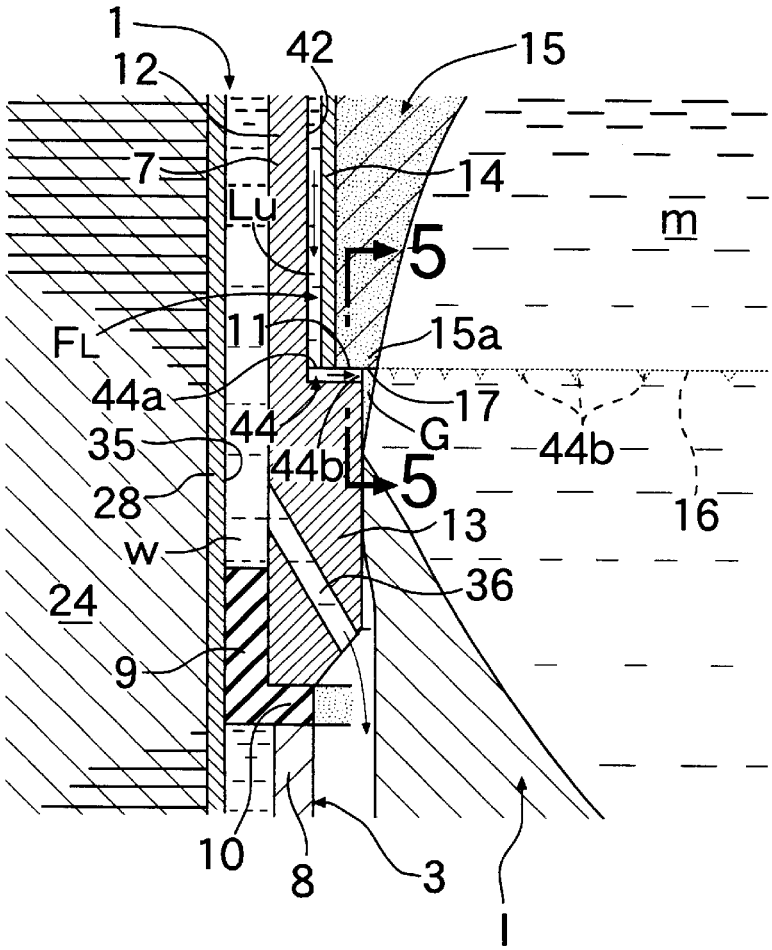
FIG. 4 is a vertical sectional view of an essential portion of a continuous casting apparatus according to a second embodiment of the present invention.
Figure 5:
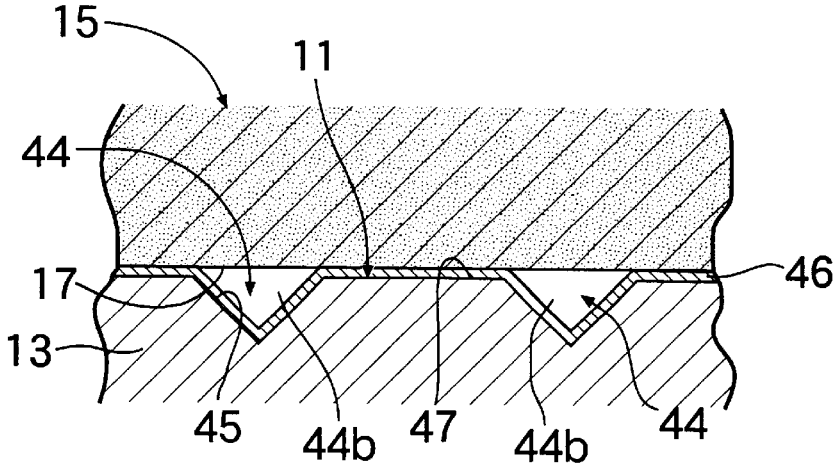
FIG. 5 is an enlarged sectional view taken along a line 5—5 in FIG. 4.

A second embodiment of a continuous casting apparatus shown in FIGS. 4 and 5 is different from the first embodiment in respect of only the structure of lubricating oil discharge passages 44. In the second embodiment, a plurality of straight discharge passages 44 are provided between the annular lower end face 17 of the spout 15 and the annular upper end face 11 of the water-cooled casting mold 13. In the illustrated embodiment, a plurality of V-grooves 45 are defined radiately in the annular upper end face 11 of the water-cooled casting mold 13, and the discharge passages 44 are defined by closing upward-turned openings of the V-grooves 45 by the annular lower end face 17 of the spout 15 and the lower end face of the cylindrical member 14. A coating layer 46 having a heat-conductivity coefficient lower than that [0.331 cal/(cm·s·deg)] of the water-cooled casting mold 13 made of the aluminum alloy (A5052) is provided on the annular upper end face 11. In the illustrated embodiment, the coating layer 46 is formed of a stainless steel foil [0.0617 cal/(cm·s·deg)] having a thickness of 50 $\mu$m, and the stainless steel foil is stuck on an inner surface of each of the V-grooves 45 and an upper surface of each of lands 47. With such construction, the lowering of the temperature of the lubricating oil Lu by the water-cooled casting mold 13 can be restrained by the coating layer 46 and hence, the vaporization of the lubricating oil Lu can be promoted more than that of the first embodiment.

A third embodiment of a continuous casting apparatus shown in FIGS. 6 to 10 is likewise different from the first embodiment in respect of only the structure of lubricating oil discharge passages 44. A discharge passage defining plate 48 defining a plurality of discharge passages 44 is disposed between the annular lower end face 17 of the spout 15 and the annular upper end face 11 of the water-cooled casting mold 13. The discharge passage defining plate 48 is formed of a material having a heat conductivity coefficient lower than the heat conductivity coefficient [0.331 cal/(cme·s·deg)] of the water-cooled casting mold 13, e.g., phosphor bronze [0.202 cal/(cm·s·deg)], a stainless steel [0.0617 cal/(cm·s·deg)] or the like.

Figure 6:
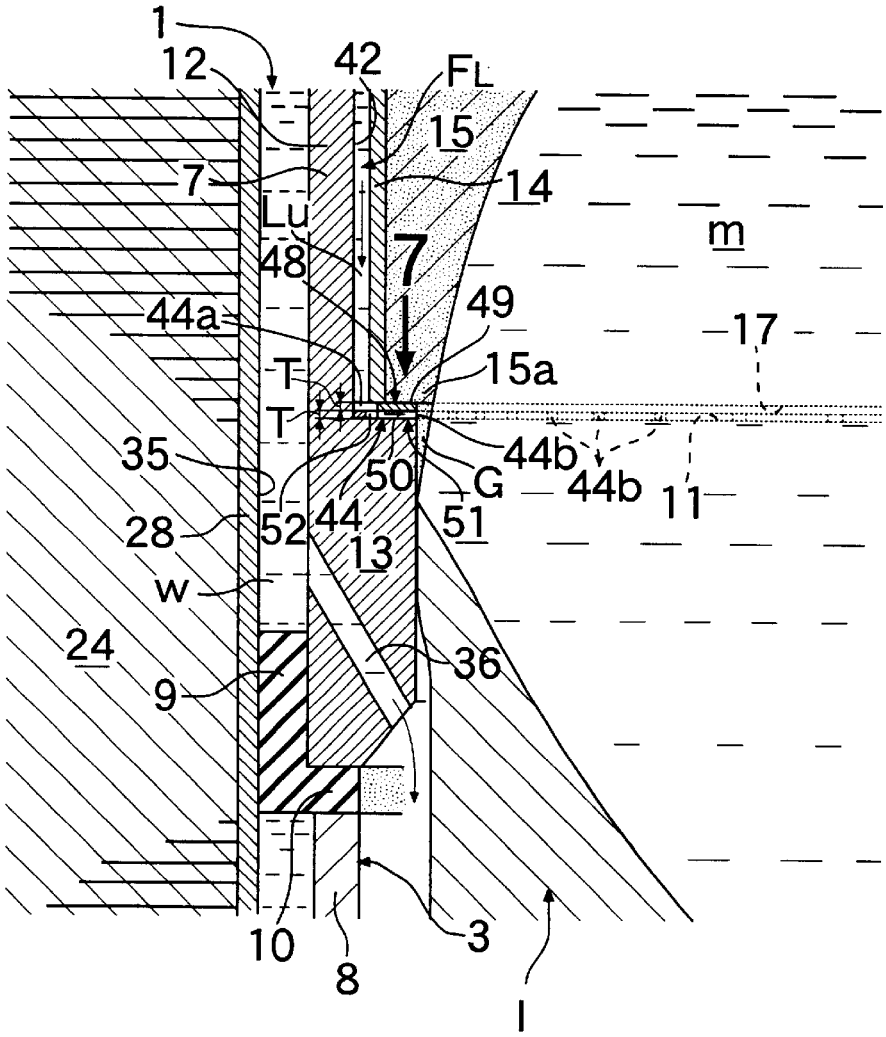
FIG. 6 is a vertical sectional view of an essential portion of a continuous casting apparatus according to a third embodiment of the present invention.
Figure 7:
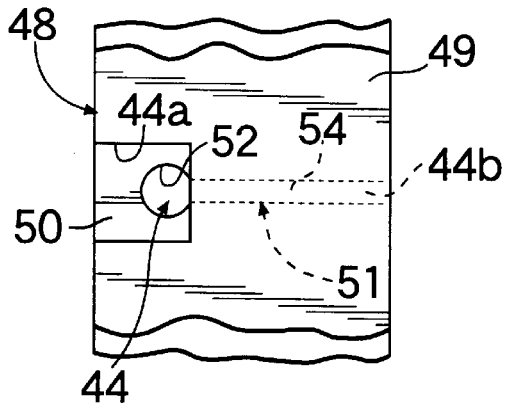
FIG. 7 is a view of a discharge passage defining plate, taken in a direction of an arrow 7 in FIG. 6.
Figure 8:
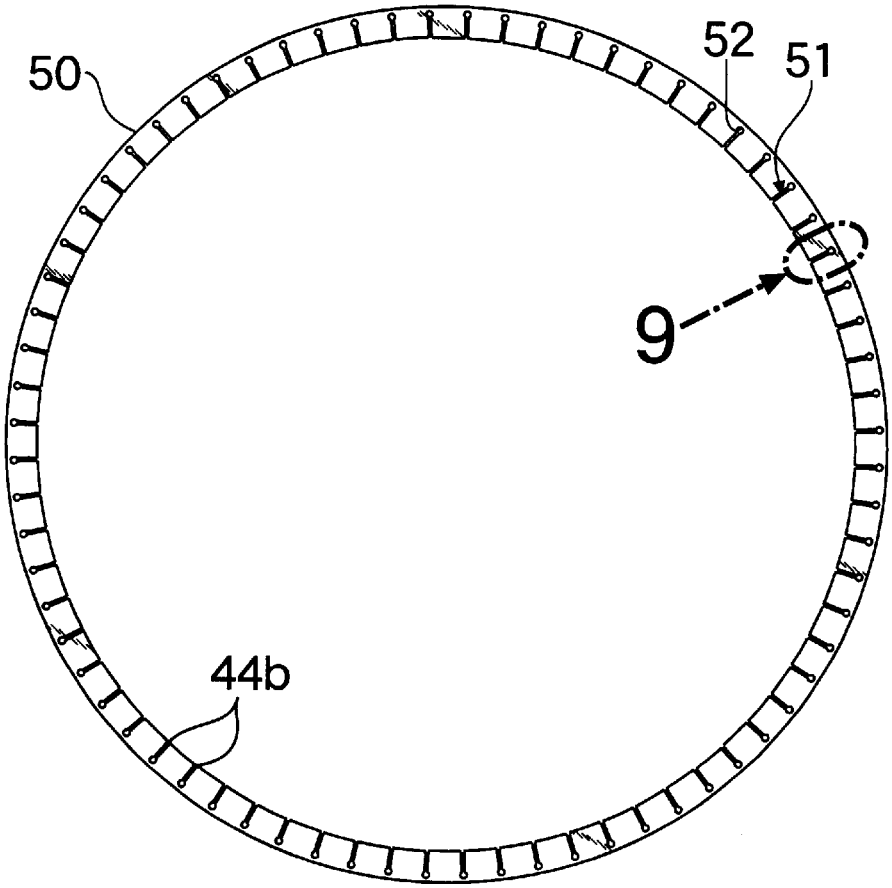
FIG. 8 is a plan view of a lower annular plate.
Figure 9:
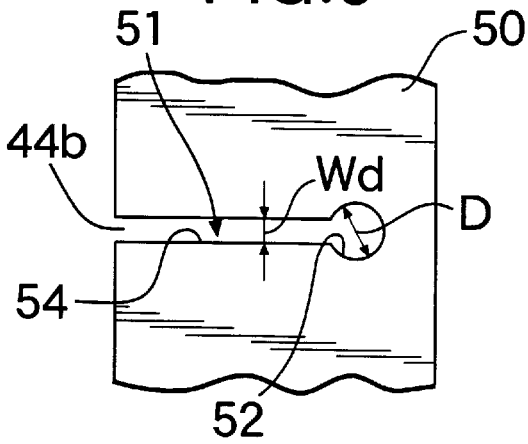
FIG. 9 is an enlarged view taken in a direction of an arrow 9 in FIG. 8.
Figure 10:
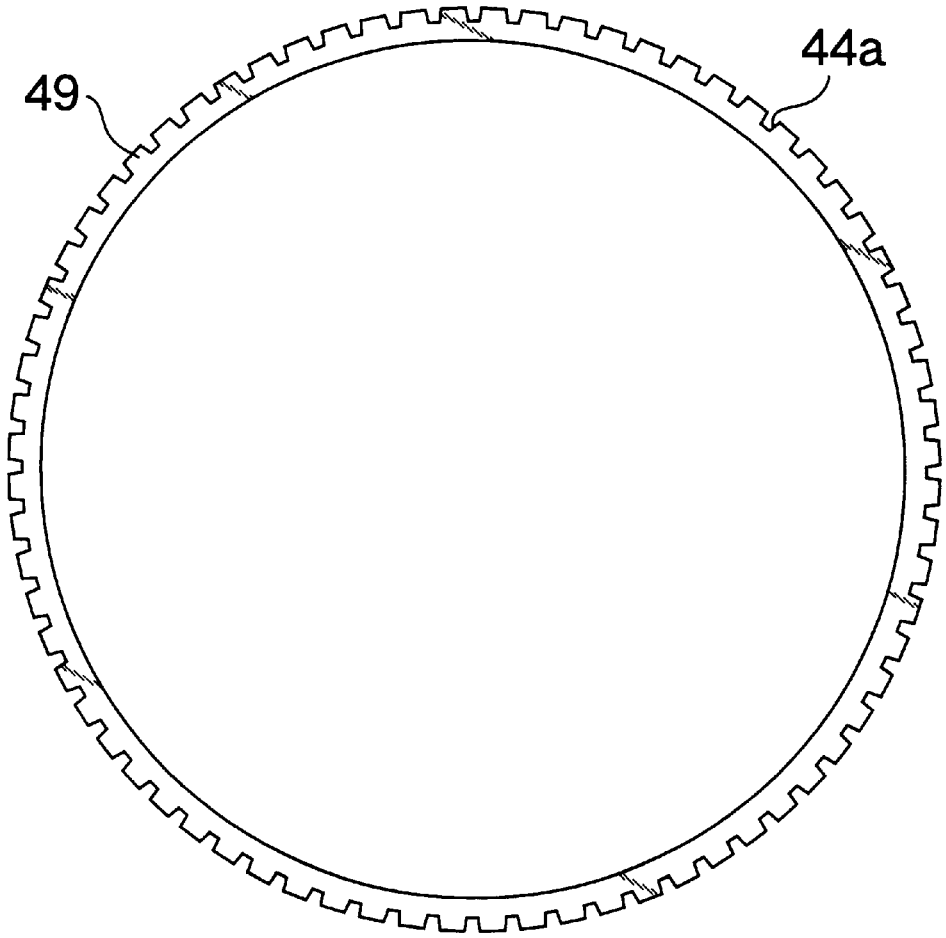
FIG. 10 is a plan view of an upper annular plate.

The discharge passage defining plate 48 is comprised of thin upper and lower annular plates 49 and 50 disposed in a superposed manner between the spout 15 and the water-cooled casting mold 13. As best shown in FIGS. 8 and 9, the lower annular plate 50 has a plurality of discharge passage slits which are disposed radiately, so that they extend from its inner peripheral surface to its outer periphery, and openings in the inner peripheral surface are outlets 44*b*. An end of each of the slits 51 on the side of its outer periphery is formed into a circular bore 52. As shown in FIG. 10, the upper annular plate 49 has a plurality of U-shaped notch inlets 44*a* disposed radiately in its outer periphery. Each of the inlets 44*a* is matched with each of the circular bores 52 located in the outer periphery of the lower annular plate 50, and is connected to the annular passage 42 located on the lubricating oil supply side, as best shown in FIGS. 6 and 7. Each of the inlets 44*a* has an area sufficiently larger than each of the circular bores 52.

If the upper annular plate 49 is disposed on the side of the annular lower end face 17 of the spout 15, as described above, the narrowing of the discharge passage 44 due to the thermal deformation of the spout 15 can be avoided. In addition, if the circular bore 52 is provided in each of the slits 51 and the area of each of the inlets 44*a* is larger, the lubricating oil Lu from the cylindrical passage 42 can be introduced smoothly through the inlets 44*a* and the circular bores 52 to main slit portions 54. The lower annular plate 50 functions as the discharge passage defining plate 48 by only itself.

EXAMPLE 1

Using the first embodiment of the continuous casting apparatus shown in FIGS. 1 to 3 and using JIS AC2B as an aluminum alloy which was a starting material, examples 1 to 11 of ingots having a diameter of 152 mm were produced in a casting manner with varied types of lubricating oils (including a lubricating mixture) Lu under conditions of a casting speed of 170 mm/min; an amount of lubricating oil supplied of 1 cc/min; an amount of cooling water supplied of 80 liters/min and a temperature of a molten metal set in a range of 650 to 690° C. in the molten metal receiving port 21 of the spout 15 and under an electromagnetic agitation of 50 Hz and 30 A using a four-pole coil.

Table 1 shows the type of the lubricating oil Lu used in the casting production of the examples 1 to 11, the vaporization rate of the lubricating oil at 300° C. and 400° C., the amount A of PTFE powder mixed and the state of the casting skin of the ingot I. In Table 1, "Passable" means that the casting skin of the ingot I is smooth, and "Good" means that the degree of smoothness is better than that in a case of "Passable". In the oil mixture, Terasu oil #22 (which is commercially available from Showa Shell Co.): caster oil= 9:1 (by weight ratio).

TABLE 1

| | Lubricating oil | | | Amount A (% by | State of |
|---|---|---|---|---|---|
| | | Vaporization rate (%) | | weight) of PTFE | casting skin of |
| Ingot | Type | 300° C. | 400° C. | mixed | ingot |
| Example 1 | Terasu oil #46 (commercially available from Showa Shell Co.) | 30 | 100 | — | Passable |
| Example 2 | | | | 1 | Good |
| Example 3 | | | | 10 | |
| Example 4 | | | | 11 | Failure (oil-baked) |
| Example 5 | Terasu oil #32 | 40 | 98 | — | Good |
| Example 6 | Mixture of Terasu oil #22 and caster oil | 49 | 98 | — | Passable |
| Example 7 | | | 92 | 4.2 | Good |
| Example 8 | Turbine oil (FBK #100 commercially available from Nisseki Co.) | 12 | 64 | — | Failure (torn off) |
| Example 9 | Turbine oil (FBK #46 commercially available from Nisseki Co.) | 16 | 98 | — | Failure (skin was roughened) |

TABLE 1-continued

| | Lubricating oil | | | Amount A (% by | State of |
|---|---|---|---|---|---|
| | | Vaporization rate (%) | | weight) of PTFE | casting skin of |
| Ingot | Type | 300° C. | 400° C. | mixed | ingot |
| Example 10 | Turbine oil (FBK #32 commercially available from Nisseki Co.) | 19 | 100 | | |
| Example 11 | Terasu oil #68 commercially available from Showa Shell Co.) | 24 | 83 | | |

It can be seen from Table 1 that in order to smoothen the casting skin of the ingot I, it is necessary to use a lubricating oil Lu having a vaporization rate of 30% or more at 300°, and that the amount A of solid lubricating agent mixed must be in a range of 1% by weight≦A≦10% by weight.

EXAMPLE 2

Using the second embodiment of the continuous casting apparatus shown in FIGS. 4 and 5, the third embodiment of the continuous casting apparatus shown in FIGS. 6 to 10 and including the upper and lower annular plates 49 and 50 made of phosphor bronze, and a fourth embodiment of a continuous casting apparatus using only a lower annular plate made of phosphor bronze for forming the discharge passage defining plate 48, examples 1 to 3 of ingots I having a diameter of 152 mm were produced in a casting manner using JIS AC2B as an aluminum alloy which was a starting material under conditions of a casting speed of 170 mm/min; a lubricating oil comprising Terasu oil #46 commercially available from Showa Shell Co.; an amount of lubricating oil supplied of 1 cc/min; an amount of cooling water supplied of 80 liter/min; a temperature of a molten metal set in a range of 650 to 690° C. in the molten metal receiving port 21 of the spout 15 and under an electromagnetic agitation of 50 Hz and 30 A using a four-pole coil.

Table 2 shows the feature of the lubricating oil discharge passage 44 and the state of the casting skin of the ingot for the examples 1 to 3. In Table 2, "Excellent" means that the degree of the smoothness of the casting skin in the ingot I is better than that in "Good".

TABLE 2

| Ingot | Feature of lubricating oil discharge passage | State of casting skin of ingot |
|---|---|---|
| Example 1 | Stainless coating layer (FIGS. 4 and 5) | Excellent |
| Example 2 | Upper and lower annular plates (FIGS. 6 to 10) | Excellent |
| Example 3 | Upper annular plate (FIG. 8 and 9) | Good |

As apparent from Table 2, in the cases of the examples 1 and 2, the supplying of the lubricating oil Lu to the discharge passage 44 was conducted smoothly and thereafter, the vaporization of the lubricating oil was promoted, and the supplying of the lubricating oil Lu to the inner peripheral surface of the water-cooled casting mold 13, namely, to between the water-cooled casting mold 13 and the molten metal m contacting with the water-cooled casting mold 13 was conducted sufficiently. Therefore, the state of the casting skin of the ingot I is excellent. In the case of the example 3, the supplying of the lubricating oil Lu to the discharge passage 44 and the vaporization of the lubricating oil Lu and the supplying of the lubricating oil Lu to the inner peripheral surface of the water-cooled casting oil 13 were hindered to some extent due to the thermal deformation of the spout 15, because only the lower annular plate 50 was used. Therefore, the state of the casting skin of the ingot I is slightly poor, as compared with the examples 1 and 2. When a coating layer 46 formed of a copper (Cu) foil in place of a stainless steel foil, namely, a coating layer 46 having a heat conductivity coefficient [0.923 cal/(cm·s·deg)] higher than the heat conductivity coefficient [0.331 cal/(cm·s·deg)] of the water-cooled casting mold 13 was used in the second embodiment of the continuous casting apparatus shown in FIGS. 4 and 5, the state of the casting surface of the ingot I was "Passable". From this, the those skilled in the art will understand the meaning that the heat conductivity coefficient of the coating layer 46 is set lower than that of the water-cooled casting mold 13.

EXAMPLE 3

A fifth embodiment of a continuous casting apparatus 1 will now be described, in which the generation of the failure of a casting skin in a light alloy ingot I due to the outlet 44*b* can be avoided without provision of a gas accumulation as described above.

The fifth embodiment of the continuous casting apparatus 1 has a structure substantially similar to that shown in FIGS. 6 to 10, and includes a spout 15 having an upward-turned molten metal receiving port 21 and a downward-turned molten metal outlet 16, a cylindrical water-cooled casting mold 13 disposed immediately below the spout 15 to cool a molten metal m from the molten metal outlet 16, an agitator 23 for applying a circumferential electromagnetic agitating force to the molten metal m, and thin upper and lower annular plates 49 and 50 which are disposed in a superposed manner between an annular lower end face 17 of the spout 15 and an annular upper end face 11 of the water-cooled casting mold 13 to define a lubricating oil discharge passage 44 having an outlet 44*b* having a size enough to supply a lubricating oil Lu to between the water-cooled casting mold 13 and the molten metal m contacting with the water-cooled casting mold 13 and to inhibit the entering of the molten metal m. The lower annular plate 50 has a plurality of outlet slits 51 extending from its inner peripheral surface to its outer peripheral surface and having openings in the inner peripheral surface, which are the outlets 44*b*. On the other hand, the upper annular plate 49 has a plurality of U-shaped notch inlets 44*a* each of which is matched with an end of each of the slits 51 located in the outer periphery of the lower annular plate 50, i.e., a circular bore 52 and connected to a cylindrical passage 42 located on the lubricating oil supply side.

In this case, the upper and lower annular plates 49 and 50 are formed of a stainless steel (JIS SUS304H) and have a thickness T (FIG. 6) set at 50 $\mu$m. Each of the slits 51 has a width Wd (FIG. 9) set at 0.5 mm, and the circular bore 52 has a diameter D (FIG. 9) set at 1.0 mm. Therefore, the size of the opening of the outlet 44*b* is 50 $\mu$m long and 0.5 mm wide. If the longitudinal length of the opening is 100 $\mu$m or less under the conditions of electromagnetic agitation, it is possible to inhibit the entering of the molten metal m into the outlet 44*b*.

EXAMPLE 4

Figure 11:
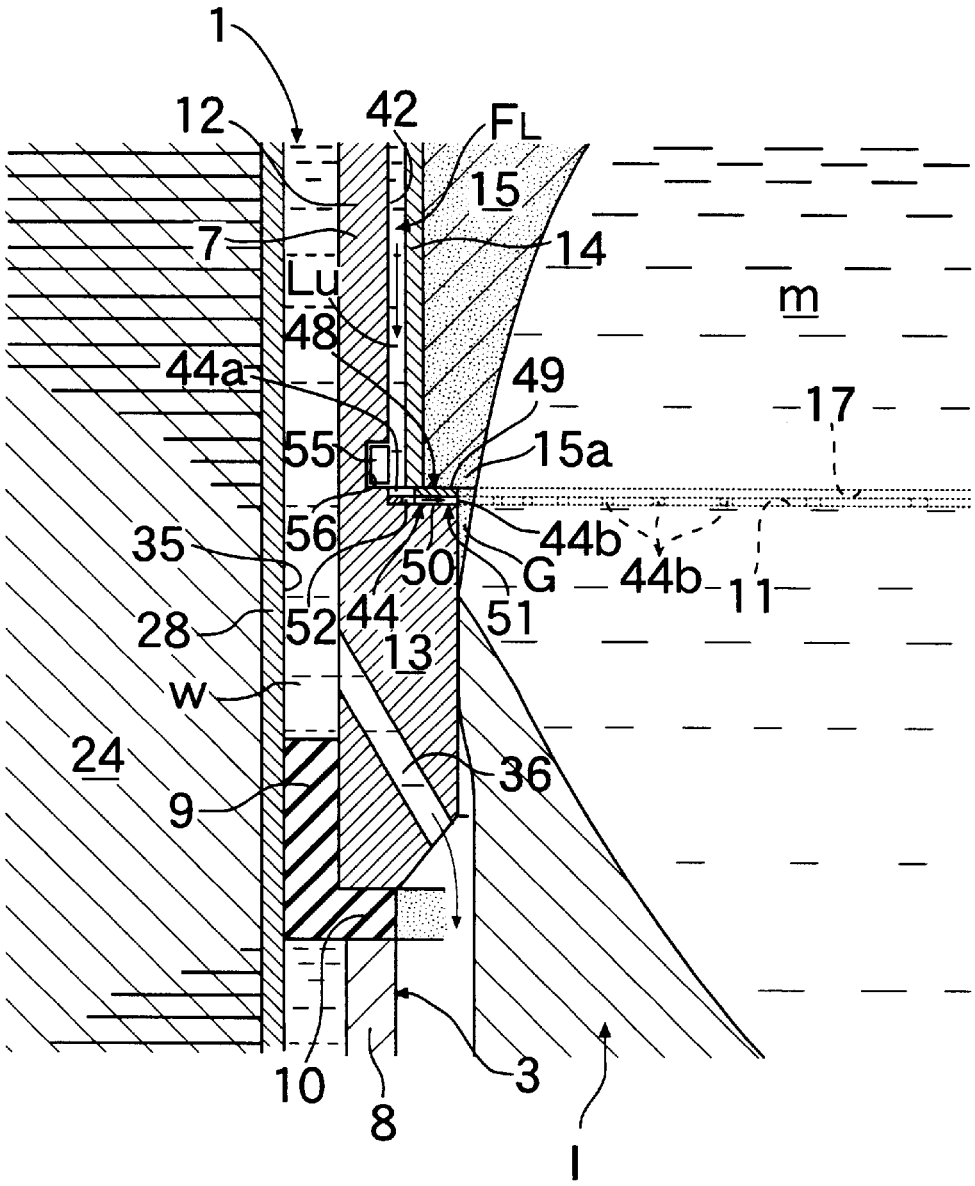
FIG. 11 is a vertical sectional view of an essential portion of a continuous casting apparatus according to a sixth embodiment of the present invention.

A sixth embodiment of a continuous casting apparatus 1 shown in FIG. 11 is similar to the apparatus of the third embodiment, except that a lubricating oil heating heater 55 is disposed in the vicinity of the inlet 44*a* of the discharge passage 44. In the illustrated embodiment, an annular groove 56 is provided immediately above the discharge passage defining plate 48 at the lower portion of the inner peripheral surface of the cylindrical member 12 to face the cylindrical passage 42, and the annular electric heater 55 is disposed in the annular groove 56. With such arrangement, the lubricating oil Lu can be positively heated by the heater 55, so that the dynamic viscosity thereof can be stabilized, whereby the lubricating oil Lu can be delivered substantially uniformly from the discharge passages 44. In this case, that portion of the lubricating oil supply passageway $F_L$ which is connected to the discharge passages 44 may not be disposed around the spout 15.

Using the sixth embodiment, the relationship between the dynamic viscosity v of the lubricating oil Lu and the number of casting skin failure points in the ingot I was considered below.

Table 3 shows the type of examples 1 to 4 of the lubricating oil Lu and the amount A of PTFE mixed. The examples 1 to 4 correspond to the examples 1, and 5 to 7 of the ingots in Table 1, respectively and hence, the vaporization rate thereof at 300° C. is 30% or more.

TABLE 3

| Lubricating oil | Type | Amount A (% by weight) of PTFE mixed |
|---|---|---|
| Example 1 | Terasu oil #46 commercially available from Showa Shell Co. | — |
| Example 2 | Terasu oil #32 commercially available from Showa Shell Co. | — |
| Example 3 | Mixture of Terasu oil #22 | — |
| Example 4 | commercially available from Showa Shell Co. and caster oil | 4.2 |

Figure 12:
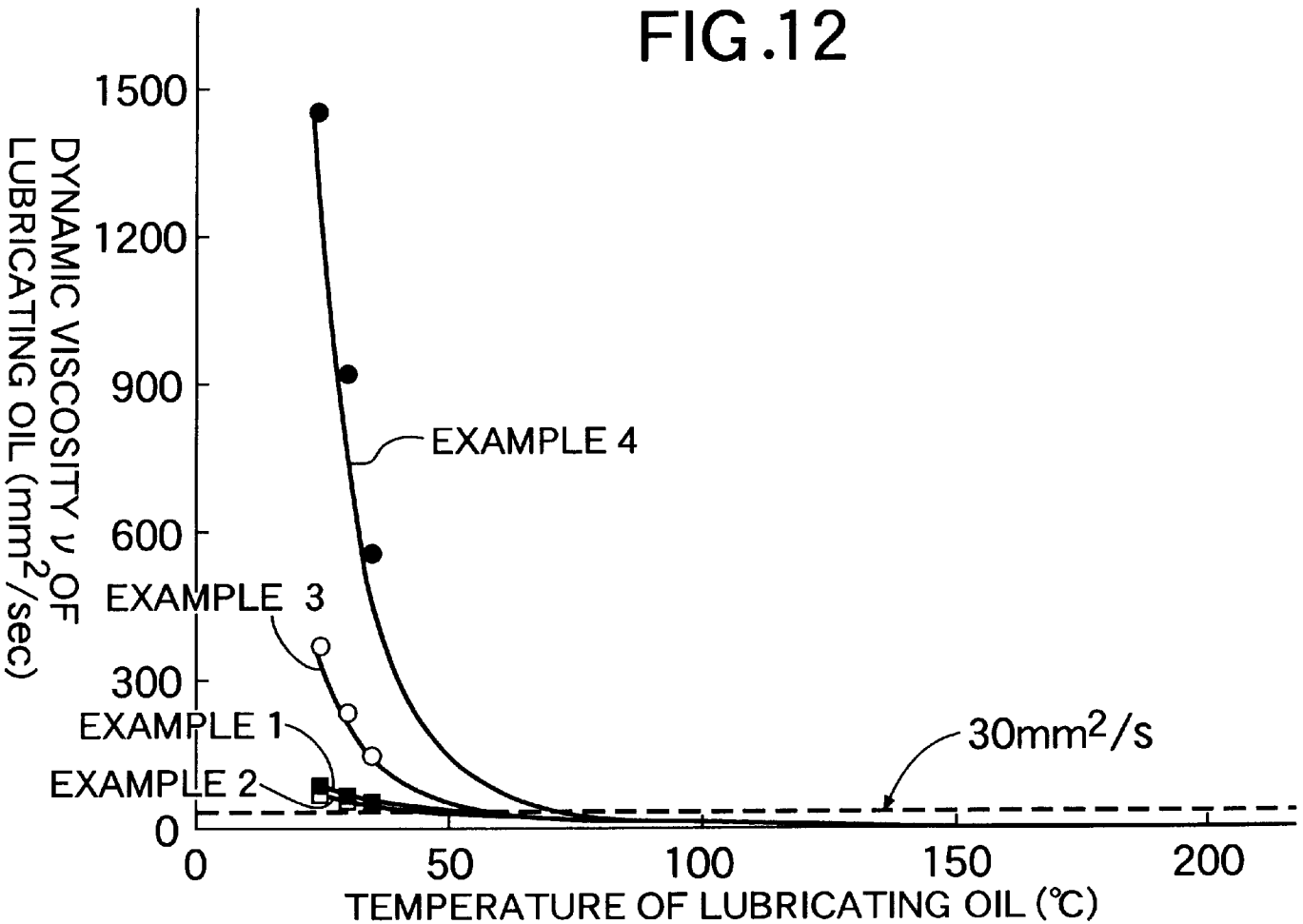
FIG. 12 is a graph showing the relationship between the temperature and the dynamic viscosity of a lubricating oil.

FIG. 12 shows the relationship between the temperature and the dynamic viscosity v of the lubricating oil Lu for the examples 1 to 4. It can be seen from FIG. 12 that in a range of the dynamic viscosity v<30 $mm^2$/sec., a variation in the dynamic viscosity v relative to a variation in temperature is extremely small.

The casting conditions were applied to those in Example 1, except that the temperature of the molten metal was set at 730° C., and the heater 55 was regulated to vary the temperature of the lubricating oil Lu in the inlet 44*a* of each of the discharge passages 44 to various levels. The above-described "number of casting skin failure points" was determined as an average number of casting skin failure points located in an area of 1 m in the outer peripheral surface of the ingot.

Figure 13:
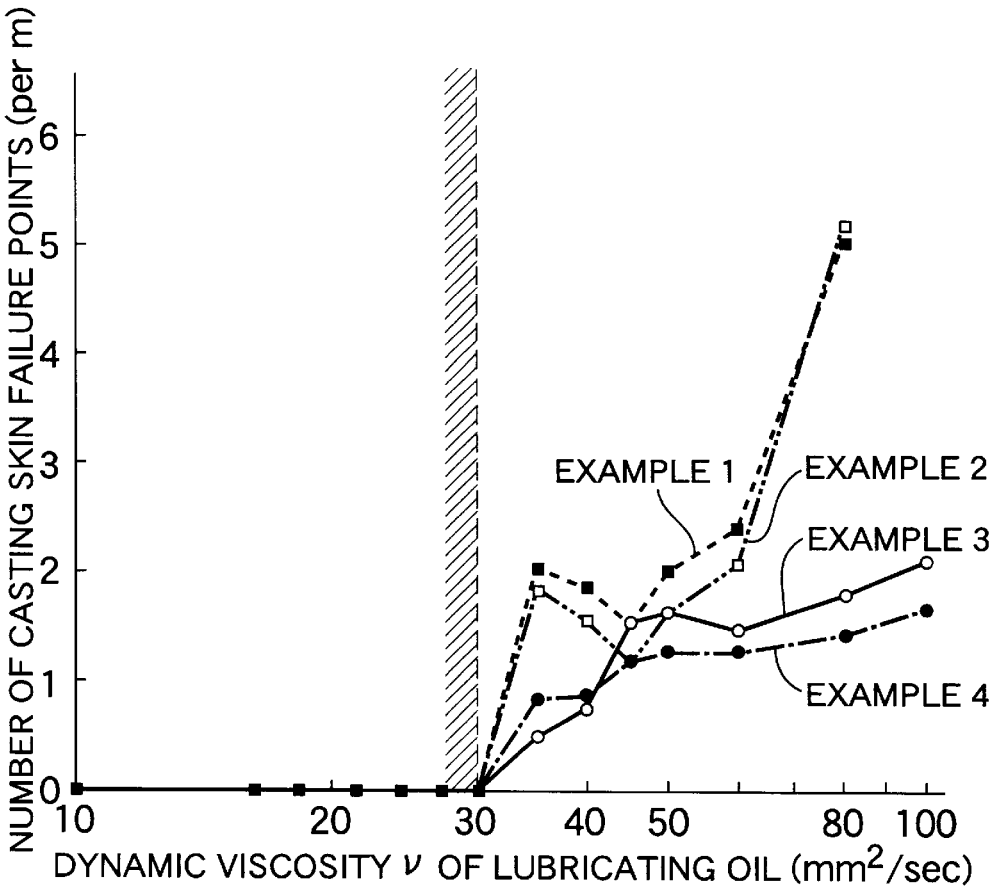
FIG. 13 is a graph showing the relationship between the dynamic viscosity of the lubricating oil and the number of failure points of a casting skin.

FIG. 13 shows the results of the above consideration. As apparent from FIG. 13, if the dynamic viscosity v of the examples 1 to 4 of the lubricating oil is set in a range of v≦30 $mm^2$/sec., an ingot I having a good casting skin can be produced.

It should be noted that a heater 55 can be also utilized in the first, second, fourth and fifth embodiments of the continuous casting apparatus 1.

[Embodiment II (FIGS. 14 to 21)]

Figure 14:
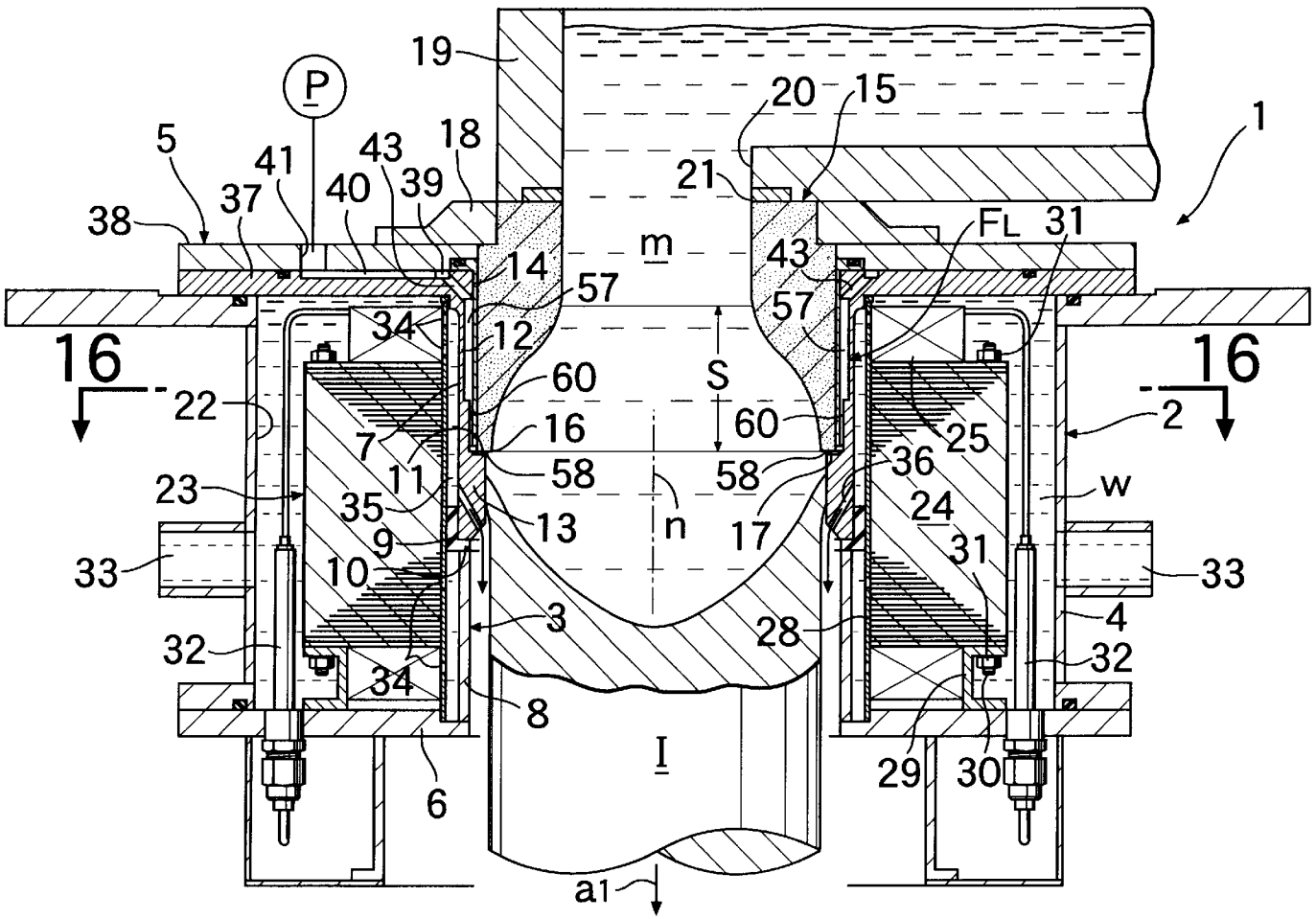
FIG. 14 is a vertical sectional view of a continuous casting apparatus according to an embodiment of the present invention.
Figure 15:
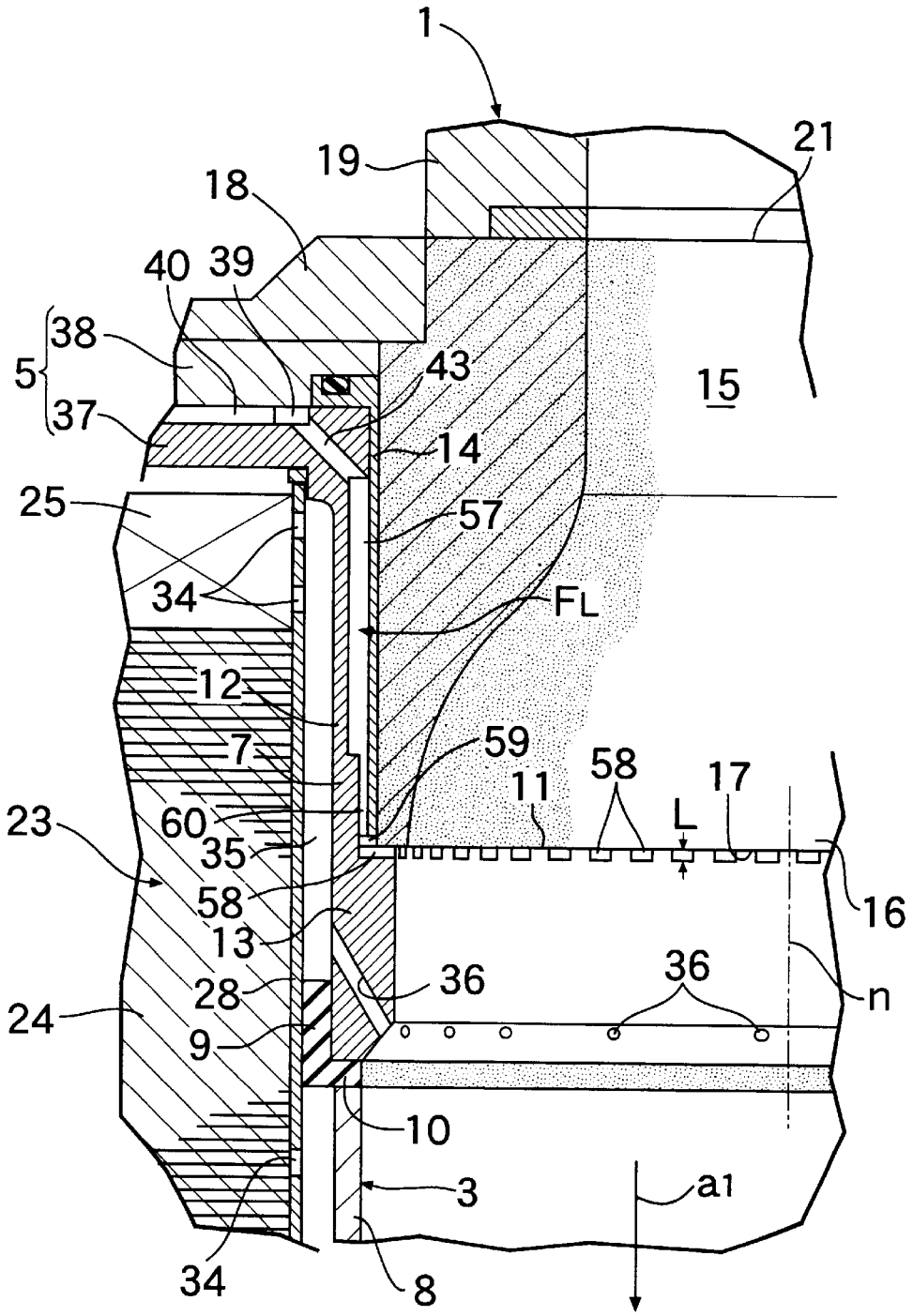
FIG. 15 is an enlarged view of an essential portion of the apparatus shown in FIG. 14.

A hot-top type continuous casting apparatus 1 shown in FIGS. 14 and 15 has a structure similar to that described in EMBODIMENT I. More specifically, the hot-top type continuous casting apparatus 1 has a drum-shaped body 2 having an axis turned vertically. The drum-shaped body 2 is comprised of an inner peripheral wall 3, an outer peripheral wall 4 disposed at a predetermined distance around an outer periphery of the inner peripheral wall 3, an annular upper end wall 5 located at upper ends of the walls 3 and 4, and an annular lower end wall 6 located at lower ends of the walls 3 and 4.

The inner peripheral wall 3 comprises an upper cylindrical portion 7 and a lower cylindrical portion 8. An inward-turned annular portion 10 of an annular rubber seal 9 fitted over an outer peripheral surface of a lower portion of the upper cylindrical portion 7 is interposed between both the cylindrical portions 7 and 8 to seal a section between both the cylindrical portions 7 and 8. A lower half of the upper cylindrical portion 7 is formed at a thickness larger than that of an upper half, so that an annular step 11 is formed inside the lower half, thereby forming a cylindrical water-cooled casting mold 13 having an axis n turned vertically. The cylindrical water-cooled casting mold 13 is formed of an aluminum alloy (e.g., A5052).

The cylindrical portion 12 surrounds a spout 15 with a thin cylindrical member 14 interposed therebetween, so that an annular lower end face 17 defining a downward-turned molten metal outlet 16 of the spout 15 abuts against the annular upper end face 11 of the water-cooled casting mold 13. An annular removal-preventing plate 18 is fitted over a portion of the spout 15, which protrudes from the upper end wall 5. The removal-preventing plate 18 is fixed to the upper end wall 5. The spout 15 is formed of calcium silicate having a heat-insulating property and a fire resistance. Alternatively, alumina, silica or the like may be used as a material for forming the spout 15. A molten metal supply tub 19 for horizontal pouring of the molten metal is disposed above the spout 15 and has a downward-turned molten metal supply port 20 which communicates with an upward-turned molten metal receiving port 21 of the spout 15.

An electromagnetic induction-type agitator 23 is disposed in a cylindrical closed space 22 between the inner and outer peripheral walls 3 and 4 of the drum-shaped body 2 and applies a circumferential electromagnetic agitating force to the molten metal m within the spout 15. The agitator 23 comprises a cylindrical stratified iron core 24 and a plurality of coils 25 wound around the stratified iron core 24. The stratified iron core 24 is comprised of a cylindrical portion 26, and a plurality of projections 27 disposed at circumferentially equal distances around an inner peripheral surface of the cylindrical portion 26 and extending in a direction of a generating line, as in the stratified iron core 24 best shown in FIG. 3. Each of the coils 25 is wound around the adjacent projections 27, so that portions of two coils 25 are overlapped on each other at one projection 27. A molten metal agitating zone S within the spout 15 is a space surrounded by a group of coils 25 forming a substantially cylindrical shape and thus, is an area from an intermediate portion within the spout 15 lying at the same level as an upper end face of the group of coils 25 to the molten metal outlet 16.

A thin cylindrical coil-retaining member 28 is fitted inside the stratified iron core 24, so that tip end faces of the projections 27 are in close contact with the coil-retaining member 28. The cylindrical member 28 is fixed within the cylindrical closed space 22 with a portion of its inner peripheral surface in close contact with the annular rubber seal 9. The stratified iron core 24 is placed onto an annular support member 29 and fixed to the support member 29 by a plurality of bolts 30 and nuts 31. A plurality of connectors 32 are prepared two for one coil 25 and mounted through the lower end wall 6 by a water-tight means.

A plurality of water supply ports 33 are defined in the outer peripheral wall 4, so that cooling water w is supplied through each of the water supply ports 33 into the closed space 22. A plurality of through-bores 34 are defined in the cylindrical member 28 inside the stratified iron core 24 and located in the vicinity of an upper end of the cylindrical member 28 and thus, a cooling water sump 35 is provided above the annular rubber seal 9. The water-cooled casting mold 13 is cooled by means of the cooling water sump 35, and has a plurality of ejection bores 36 for ejecting the cooling water w in the cooling water sump 35 obliquely and downwards. Through-bores 34 are also defined in a lower portion of the cylindrical member 28.

In order to supply a lubricating oil to the inner peripheral surface of the water-cooled casting mold 13, a lubricating oil supply passageway $F_L$ , which will be described below, is provided around the spout 15. A lower plate 37 of the upper end wall 5 is integrally provided at an upper end of the upper cylindrical portion 7 of the inner peripheral wall 3. Provided between an upper plate 38 and the lower plate 37 of the upper end wall 5 are an annular passage 39 surrounding the spout 15, and a plurality of straight passages 40 extending radiately from the annular passage 39. An inlet 41 defined in the upper plate 38 communicates with ends of the straight passages 40, and is connected to an oil supply pump P. As best shown in FIG. 15, a plurality of, e.g., eight (in the illustrated embodiment) distributing passages 42 are defined between the inner peripheral surface of the upper half 12 of the upper cylindrical portion 7 and an outer peripheral surface of the cylindrical member 14, and a plurality of obliquely-turned through-bores 43 are defined in a connection between the cylindrical portion 12 and the lower plate 37 to permit the communication between the cylindrical passage 42 and the annular passage 39. A plurality of obliquely downward-turned through bores 43 are defined in a connection between the upper half 12 and the lower plate 37 to permit the communication between the distributing passages 57 and the annular passage 39. Lower ends of the distributing passages 57 communicate, through annular passages 59, with a plurality of, e.g., sixty four (in the illustrated embodiment) discharge ports 58 which are arranged radiately in the vicinity of the annular upper end face 11 of the water-cooled casting mold 13, e.g., between the upper end face 11 and the annular lower end face 17 of the spout 15 in the embodiment. Any of vegetable oils such as caster oil, rape oil and the like or a mixture of any one of them and a mineral oil or a synthetic oil may be used as the lubricating oil.

In FIG. 14, when a molten metal m having, for example, an aluminum alloy composition is supplied from the molten metal supply port 20 of the molten metal supply tub 19 into the spout 15, the molten metal m is introduced into the water-cooled casting mold 13 disposed immediately below the spout 15, while being rotated circumferentially under an electromagnetic agitating force provided by the agitator 23 within the spout 15, and is then cooled in the water-cooled casting mold 13 to provide an ingot I. During this time, the lubricating oil is discharged from the each of discharge ports 58. In this case, a direction of withdrawing the ingot is from above to below.

Figure 16:
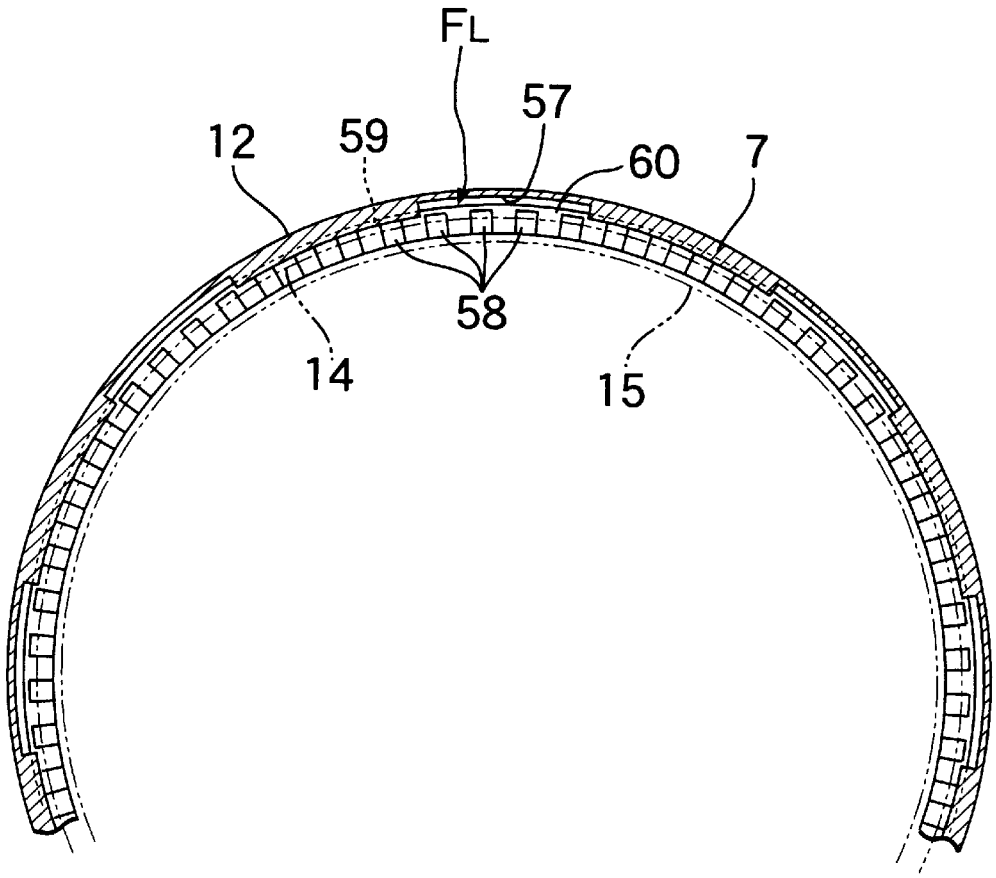
FIG. 16 is a sectional view of an essential portion of an upper cylindrical member, taken along a line 16—16 in FIG. 14.
Figure 17:
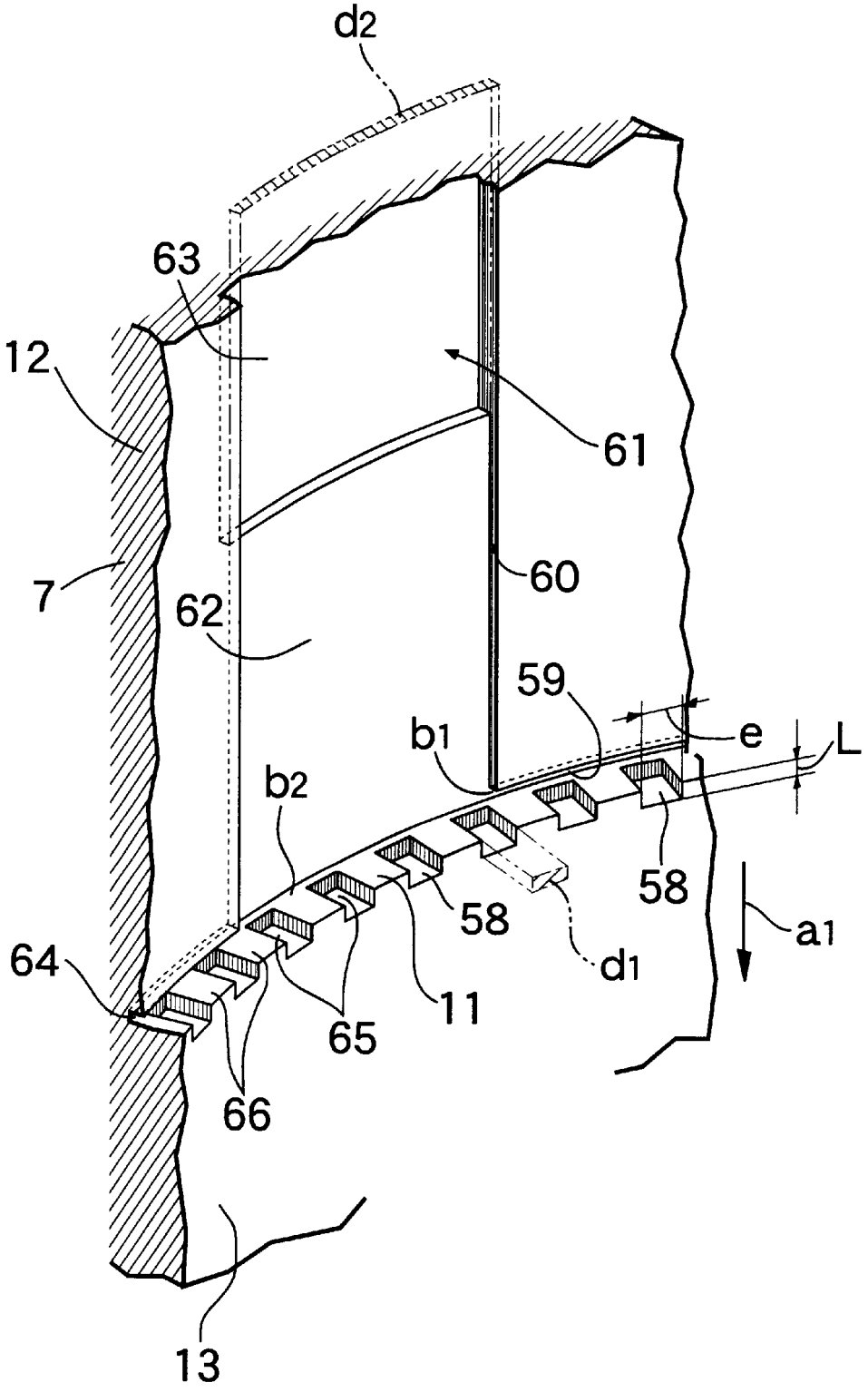
FIG. 17 is a perspective view of an essential portion of the upper cylindrical member.

In the continuous casting apparatus 1, each of the distributing passages 57 has a constriction 60 at its lower portion, as shown in FIGS. 15 and 16. As best shown in FIG. 17, a recessed groove 61 for defining each of the distributing passages 57 is defined to extend along a generatrix line, and that portion 62 of the recessed groove 61 corresponding to the constriction is narrower than a main portion 63 excluding such portion. A lower end of each of the constriction-correspondence portions 62 opens into upper portions $b_1$ of a pair of opposed inner walls of an annular groove 64 which has a U-shaped in section and opens inwards. Lower portion b2 of the opposed inner walls lies on a plane extending from the annular upper end face 11 of the water-cooled casting mold 13.

Recesses 65 for defining the discharge ports 58 are defined in the annular upper end face 11, whereby the discharge port 58 having a quadrilateral opening is defined by placing the annular lower end face 17 of the spout 15 onto a land 66 between the adjacent recessed grooves 65, as shown in FIG. 15. Annular passages 59 each permitting the communication between each of the constrictions 60 and each of the discharge ports 58 are defined by cooperation of the annular lower end face of the cylindrical member 14, the outer peripheral surface of the lower end of the spout 15 and the outer periphery of the annular upper end face 11, and has an inner periphery which is opposed to an outer end of each of the discharge ports 58.

In FIG. 17, the length L (mm) of each of the discharge ports 58 in the ingot-withdrawing direction is set at a value which enables the generation of a break-out to be avoided. Further, the relationship between a sum $A_1$ ($d_1$×64) of the sectional areas $d_1$ ($mm^2$) of all the discharge ports 58 and a sum $A_2$ ($d_2$×8) of the sectional areas $d_2$ ($mm^2$) of all the constrictions 60 is set at $A_1>A_2$, and the ratio $A_2/A_1$ between the sums $A_1$ and $A_2$ of the sectional areas is set in a range of $$Lmin/L \leqq A_2/A_1 \leqq 1-(1/Fmax)F$$

wherein Lmin (mm) is a minimum value of the length of the discharge port 58 in the ingot-withdrawing direction and varies depending on the capacity of the oil supply pump P; F(Hz) is a frequency for the vibration of a molten metal pressure applied to the discharge port 58 and assumes a value $f_1$, when the molten metal m is not agitated, and a value ($f_1$+$f_2$) resulting from addition of an agitation frequency $f_2$ to the value $f_1$, when the molten metal m is agitated; and Fmax (Hz) is a frequency for the vibration of the molten metal pressure applied to the discharge port 58 when the ratio $A_2/A_1$=0. The frequency $f_1$ (Hz) in the non-agitated molten metal state due to the hot-top type is represented by $f_1$=(c/60×(1/L), wherein c represents an ingot-withdrawing speed (mm/min). In this case, c/60 means that the speed is converted into a speed per second.

With the above arrangement of the continuous casting apparatus, when the vibration of the molten metal m is applied to each of the discharged ports 58, the internal pressure in each of the discharge ports 58 rises with such application due to the presence of the constriction 60. Therefore, the entering of the molten metal m into the discharge ports 58 and the attendant back flow of the lubricating oil are prevented, and the vibration of the molten metal m cannot be applied directly to each of the constrictions 60 and hence, an amount of the lubricating oil controlled by the constriction 60 is discharged uniformly from each of the discharge ports 58. Thus, it is possible to prevent the roughening of the casting skin of the ingot I, the generation of a break-out and the like.

A particular example will be described below.

Table 4 shows the composition of an aluminum alloy used in this particular example.

TABLE 4

| Chemical constituent (% by weight) | | | | | | | | | | |
|---|---|---|---|---|---|---|---|---|---|---|
| Cu | Si | Mg | Zn | Fe | Mn | Ni | Cr | Ti | Sr | Al |
| 4.7 | 7.5 | 0.26 | 0.47 | 0.77 | 0.48 | 0.07 | 0.1 | 0.13 | 0.02 | balance |

Using the aluminum alloy, an ingot I was produced in a casting manner by the above-described continuous casting apparatus without agitation of the molten metal m with the electromagnetic induction-type agitator 23 being in an non-operated state. In this case, the melting temperature was 730° C.; the temperature of the molten metal immediately above the spout 15 was 650° C.; the diameter of the ingot I was 152 mm; and the ingot-withdrawing speed c was variable.

Table 5 shows the sectional area $d_1$ (constant) and the like of the discharge port 58 and the sectional area $d_2$ (variable) of the constriction 60, and Table 6 shows the sum $A_1$ (constant) of the sectional areas, the sum $A_2$ (variable) of the sectional areas and the sum ratio $A_2/A_1$.

TABLE 5

| Discharge port | | | sectional area |
|---|---|---|---|
| Length L in withdrawing direction (mm) | Circumferential width e (mm) | Sectional area d1 ($mm^2$) | d2 of constriction ($mm^2$) |
| 0.05 | 1.0 | 0.05 | 0.32 |
| | | | 0.24 |
| | | | 0.2 |
| | | | 0.12 |
| | | | 0.072 |
| | | | 0.04 |

TABLE 6

| $A_1 = d_1 \times 64$ $A_2 = d_2 \times 8$ | | |
|---|---|---|
| Sum $A_1$ of sectional areas $d_1$ of all discharge ports ($mm^2$) | Sum $A_2$ of sectional areas $d_2$ of all constrictions ($mm^2$) | Ratio $A_2/A_1$ between sums $A_1$ and $A_2$ of sectional areas |
| 3.2 | 2.56 | 0.8 |
| | 1.92 | 0.6 |
| | 1.6 | 0.5 |
| | 0.96 | 0.3 |
| | 0.576 | 0.18 |
| | 0.32 | 0.1 |

[1] Upper Limit of Ratio $A_2/A_1$ Between the Sectional Areas

Table 7 hows the relationship between the ingot-withdrawing speed c, the length L of the discharge port 58 in the ingot-withdrawing direction as well as the frequency F=$f_1$ for the vibration of the molten metal pressure, and the ratio $A_2/A_1$ of the sums $A_1$ and $A_2$ of both the sectional areas, and the number of roughened portions of the casting skin per 1 m of the ingot I.

TABLE 7

| Ingot-withdrawing speed c | Length L of discharge port in ingot-withdrawing direction | Frequency $f_1$ for vibration of molten metal pressure | Ratio $A_2/A_1$ of sums $A_1$ and $A_2$ of both sectional areas | | | | | |
|---|---|---|---|---|---|---|---|---|
| (mm/min) | (mm) | (Hz) | 0.8 | 0.6 | 0.5 | 0.3 | 0.18 | 0.1 |
| 100 | 0.05 | 33.3 | 0 | 0 | 0 | 0 | 0 | 0 |
| 120 | | 40 | 0 | 0 | 0 | 0 | 0 | 0 |
| 140 | | 46.7 | 4.1 | 0 | 0 | 0 | 0 | 0 |
| 160 | | 53.3 | 4.3 | 0 | 0 | 0 | 0 | 0 |
| 180 | | 60 | 5.1 | 0 | 0 | 0 | 0 | 0 |
| 200 | | 66.7 | 6 | 0 | 0 | 0 | 0 | 0 |
| 220 | | 73.3 | 6.4 | 0 | 0 | 0 | 0 | 0 |
| 240 | | 80 | 6.9 | 0 | 0 | 0 | 0 | 0 |
| 260 | | 86.7 | 7 | 5.1 | 0 | 0 | 0 | 0 |
| 270 | | 90 | 7.1 | 5.3 | 0 | 0 | 0 | 0 |
| 280 | | 93.3 | 7.4 | 5.7 | 0 | 0 | 0 | 0 |
| 290 | | 96.7 | 7.3 | 6 | 0 | 0 | 0 | 0 |
| 300 | | 100 | 7.8 | 6 | 0 | 0 | 0 | 0 |
| 350 | | 116.7 | 7.6 | 5.9 | 5.1 | 0 | 0 | 0 |
| 400 | | 133.3 | 8.1 | 6.7 | 5.4 | 0 | 0 | 0 |
| | $F = f_1$, $f_1 = (c/60) \times (1/L)$ | | Number of roughened portions of casting skin in ingot (per m) | | | | | |

Table 8 shows the relationship between the ingot-withdrawing speed c when the molten metal m was agitated by operating the electromagnetic induction-type agitator 23, the length L of the discharge port 58 in the ingot-withdrawing direction as well as the frequency $F=f_1$ (see Table 7)+$f_2$ for the vibration of the molten metal pressure, and the ratio $A_2/A_1$ of the sums $A_1$ and $A_2$ of both the sectional areas, and the number of roughened portions (including recessed traces and the like) of the casting skin per 1 m of the ingot I.

TABLE 8

| Ingot-withdrawing speed c | Length L of discharge port in ingot-withdrawing direction | Frequency $f_1 + f_2$ for vibration of molten metal pressure | Ratio $A_2/A_1$ of sums $A_1$ and $A_2$ of both sectional areas | | | | | |
|---|---|---|---|---|---|---|---|---|
| (mm/min) | (mm) | (Hz) | 0.8 | 0.6 | 0.5 | 0.3 | 0.18 | 0.1 |
| 100 | 0.05 | 58.3 | 5.1 | 0 | 0 | 0 | 0 | 0 |
| 120 | | 65 | 5 | 0 | 0 | 0 | 0 | 0 |
| 140 | | 71.7 | 5.4 | 0 | 0 | 0 | 0 | 0 |
| 160 | | 78.3 | 5.9 | 0 | 0 | 0 | 0 | 0 |
| 180 | | 85 | 6 | 5.1 | 0 | 0 | 0 | 0 |
| 200 | | 91.7 | 6.1 | 5.3 | 0 | 0 | 0 | 0 |
| 220 | | 98.3 | 6.4 | 5.7 | 0 | 0 | 0 | 0 |
| | $f_2 = 25$ Hz | 105 | 6.3 | 6 | 4.3 | 0 | 0 | 0 |
| 260 | | 111.7 | 6.8 | 6 | 5.1 | 0 | 0 | 0 |
| 270 | | 115 | 6.4 | 5.7 | 4.2 | 0 | 0 | 0 |
| 280 | | 118.3 | 6.3 | 6 | 4.4 | 0 | 0 | 0 |
| 290 | | 121.7 | 6.8 | 6 | 5.1 | 0 | 0 | 0 |
| 300 | | 125 | 7.1 | 6.7 | 5.4 | 0 | 0 | 0 |
| 350 | | 141.7 | 6.6 | 5.9 | 5.1 | 4.3 | 0 | 0 |
| 400 | | 158.3 | 7.1 | 6.7 | 5.6 | 4.4 | 0 | 0 |
| 400 | $f_2 = 29.3$ Hz → | 162.6 | 6.8 | 4.6 | 5.7 | 5 | 0 | 0 |
| 400 | $f_2 = 41.7$ Hz → | 175 | 5.7 | 6.7 | 5.8 | 5.2 | 3.1 | 0 |
| 400 | $f_2 = 46.7$ Hz → | 180 | 8.1 | 7.1 | 7.1 | 5.3 | 4.3 | 0 |
| | $F = f_1 + f_2$ | | Number of roughened portions of casting skin in ingot (per m) | | | | | |

When no constriction 60 is provided in each of the distributing passages 57 of the lubricating supply passageway $F_L$ and the ratio $A_2/A_1$ of the sums $A_1$ and $A_2$ of both the sectional areas is equal to 1, the entering of the molten metal m into the discharge port 58 and the like were observed in the above-described casting operation, unless the frequency F was 0 Hz. Namely, when F>0 Hz, the constrictions 60 are required in order to prevent the entering of the molten metal m into the discharge ports 58 and the like.

On the other hand, it was made clear that when the ratio $A_2/A_1$ was equal to 0, namely, the sum $A_2$ of the sectional areas of the constructions 60 was equal to 0 $mm^2$, and the frequency F at the time when the molten metal m enters the discharge ports 58 formed, for example, into a blind bore shape was represented by Fmax, Fmax≅200 Hz in the above-described casting example with the agitation of the molten metal m conducted. This means that when Fmax≧200 Hz, the supplying of the lubricating oil can be carried out.

Figure 18:
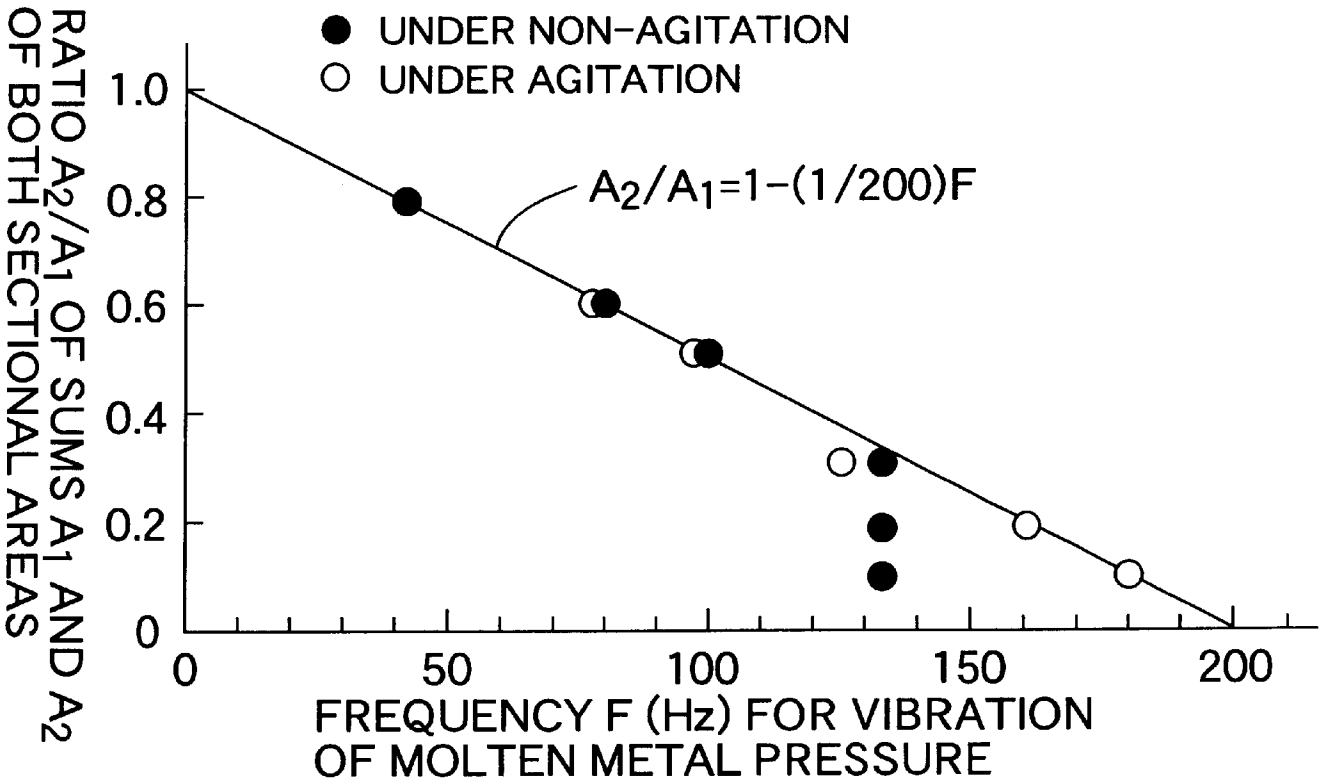
FIG. 18 is a graph showing the relationship between the frequency F for the vibration of a molten metal pressure and the ratio $A_2/A_1$ of sums $A_1$ and $A_2$ of both sectional areas.

FIG. 18 is a graph made by taking the frequency F on an axis of x of rectangular coordinates and taking the ratio $A_2/A_1$ of the sums $A_1$ and $A_2$ of both the sectional areas on an axis of y of the rectangular coordinates, connecting a limit point of the ratio $A_2/A_1$ and a limit point of the frequency F to each other, and plotting the relationship between the ratio $A_2/A_1$ when the number of roughened portions of the casting skin in the ingot I is zero, and the maximum value of the frequency F on the basis of Table 7 and 8. A line segment connecting both the limit points (0,1.0) and (200,0) to each other is represented as $A_2/A_1=1-(1/Fmax)F$, namely, $A_2/A_1=1-(1/200)F_1$ and it was made clear that points indicating that the number of roughened portions of the casting skin is zero are located on or below the line segment. Thus, in order to ensure that the number of roughened portions of the casting skin is zero, it is necessary to determine the relationship between the ratio $A_2/A_1$ and the frequency F as $A_2/A_1=1-(1/Fmax)F$.

[2] Length L of Discharge Port in Ingot-withdrawing Direction

The casting operation was carried out with the length L of the discharge ports 58 in the ingot-withdrawing direction set as a variable under conditions of an ingot withdrawing speed c equal to 100 mm/min and a ratio $A_2/A_1$ equal to 0.1 or 0.5 and under conditions of an ingot withdrawing speed c equal to 400 mm/min and a ratio $A_2/A_1$ equal to 0.1 or 0.5 at a frequency $f_2$ of agitation of the molten metal m equal to 25 Hz, and the relationship between the length L and the generation of a break-out was examined to provide results shown in Table 9.

TABLE 9

| Length of discharge port in ingot withdrawing direction (mm) | Number of roughened portions of casting skin in ingot (per m) | | | |
|---|---|---|---|---|
| | Ingot withdrawing speed c = 100 mm/min | | Ingot withdrawing speed c = 400 mm/min | |
| | $A_2/A_1$ = 0.1 | $A_2/A_1$ = 0.5 | $A_2/A_1$ = 0.1 | $A_2/A_1$ = 0.5 |
| 0.01 | Break-out | Break-out | Break-out | Break-out |
| 0.015 | | | | |
| 0.02 | | | | |
| 0.025 | | | | |
| 0.03 | | | | |
| 0.035 | | | | |
| 0.04 | | | | |
| 0.045 | 0.11 | 2.2 | 0.3 | 2.61 |
| 0.05 | 0 | 0 | 0 | 5.6 |
| 0.06 | 0 | 2.4 | 0.9 | 3.3 |
| 0.07 | 0 | 3.2 | 0.4 | 3.6 |
| 0.08 | 0.2 | 1.2 | 0.3 | 1.7 |
| 0.09 | 0.32 | 0.98 | 0.23 | 1.53 |
| 0.1 | 0.01 | 0.5 | 0.01 | 0.52 |
| 0.2 | 0.09 | 0.3 | 0.08 | 0.47 |
| 0.3 | 0 | 0.2 | 0.1 | 0.3 |
| 0.4 | 0 | 0.1 | 0 | 0.1 |
| 0.5 | 0 | 0.1 | 0.1 | 0.2 |
| 0.6 | 0.2 | 0.01 | 0.32 | 0.09 |
| 0.7 | 0.3 | 0.01 | 0.23 | 0.08 |
| 0.8 | 1.2 | 0.5 | 0.98 | 0.3 |
| 0.9 | 1.7 | 0.52 | 1.53 | 0.47 |
| 1 | 0.3 | 0.01 | 0.23 | 0.08 |
| 1.5 | 1.2 | 0.5 | 0.98 | 0.3 |
| 2 | Break-out | Break-out | Break-out | Break-out |
| 2.5 | | | | |
| 3 | | | | |
| 4 | | | | |
| 5 | | | | |

It can be seen from Table 9 that in order to avoid the break-out, it is necessary to set the length L in the ingot withdrawing direction in a range of 0.045 mm≦L≦1.5 mm. However, if L<0.045 mm, the lubricating oil is difficult to exit the discharge port 58, or may be failed to exit the discharge port in some times because of the small length L, resulting in the break-out. On the other hand, if L>1.5 mm, the molten metal m enters the discharge port 58 even if the constrictions 60 are provided, because of the large length L, resulting in the break out.

[3] Lower Limit of Ratio $A_2/A_1$ of Sums $A_1$ and $A_2$ of Both Sectional Areas If the minimum value of the length L of the discharge port 58 in the ingot withdrawing direction, which is enough to enable the discharging of the lubricating oil, is represented by Lmin (mm), the lower limit value of the ratio $A_2/A_1$ is set to be equal to Lmin/L, in order to ensure that the roughening of the casting skin of the ingot I is not produced. In the embodiment, the minimum value Lmin is equal to 0.0045 mm from the relationship to the capacity of the supply pump P.

Figure 19:
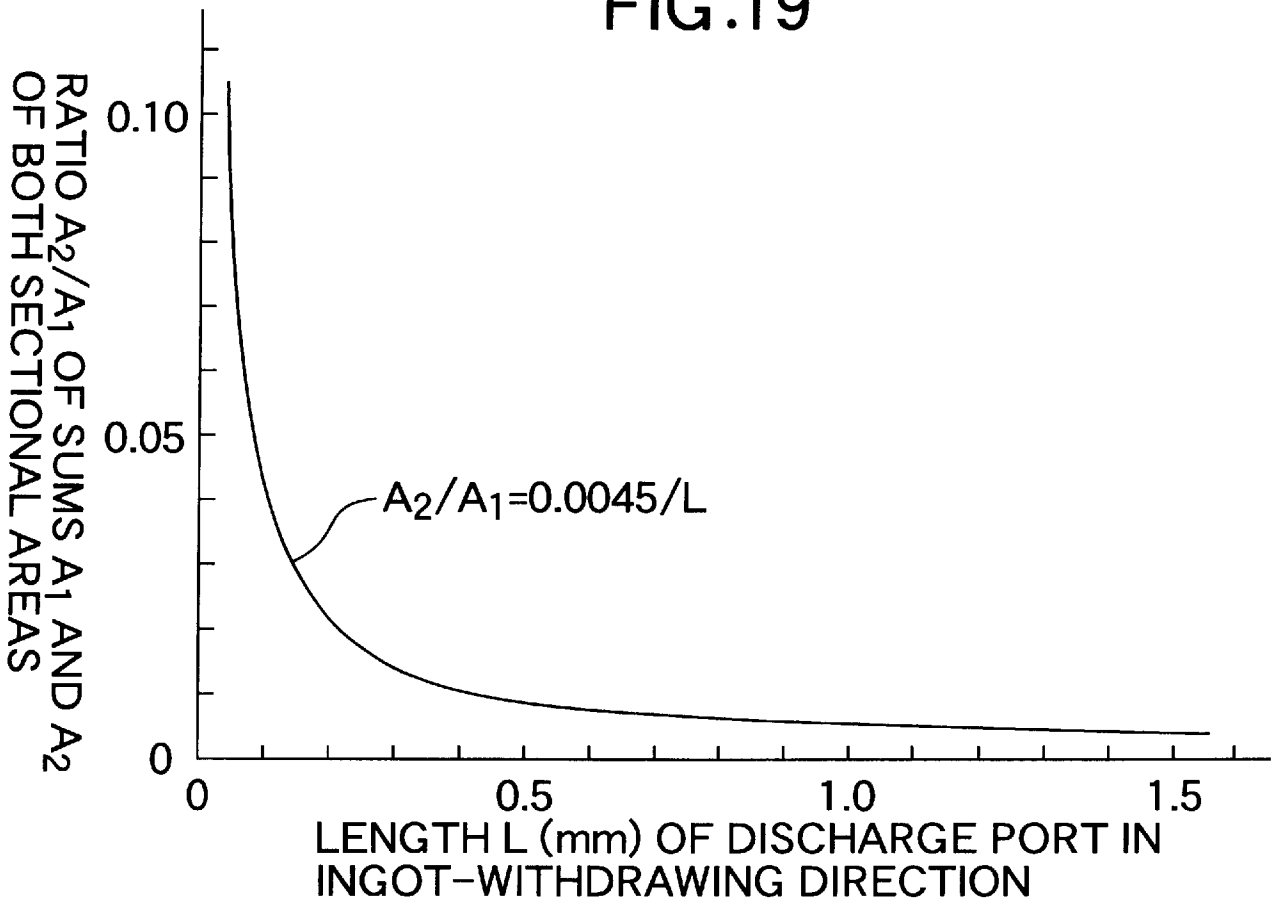
FIG. 19 is a graph showing the relationship between the length L of a discharge port in an ingot-withdrawing direction and the ratio $A_2/A_1$ of the sums $A_1$ and $A_2$ of both the sectional areas.

FIG. 19 shows the ratio $A_2/A_1$ equal to 0.0045/L, when the length L of the discharge port 58 in the ingot withdrawing direction is taken on an axis of x and the ratio $A_2/A_1$ of the sums $A_1$ and $A_2$ of both the sectional areas is taken on an axis of y in a rectangular coordinates. Therefore, the ratio $A_2/A_1$ is set in a range of the ratio $A_2/A_1 \geqq Lmin/L$. [4] Gradient of Discharge Port and Quality of Ingot The lubricating oil is vaporized in an opened end of each of the discharge port 58 to generate a gas. When this gas enters the lubricating oil supply passageway $F_L$ and is not discharged therefrom smoothly, the passageway $F_L$ is clogged with the lubricating oil, resulting in a reduction in quality of the appearance of the ingot I due to the roughening of the casting surface. When the gas enters the molten metal m, the quality of the appearance of the ingot I due to the generation of voids.

Such behavior of the gas depends on the gradient of each of the discharge ports 58.

Figure 20:
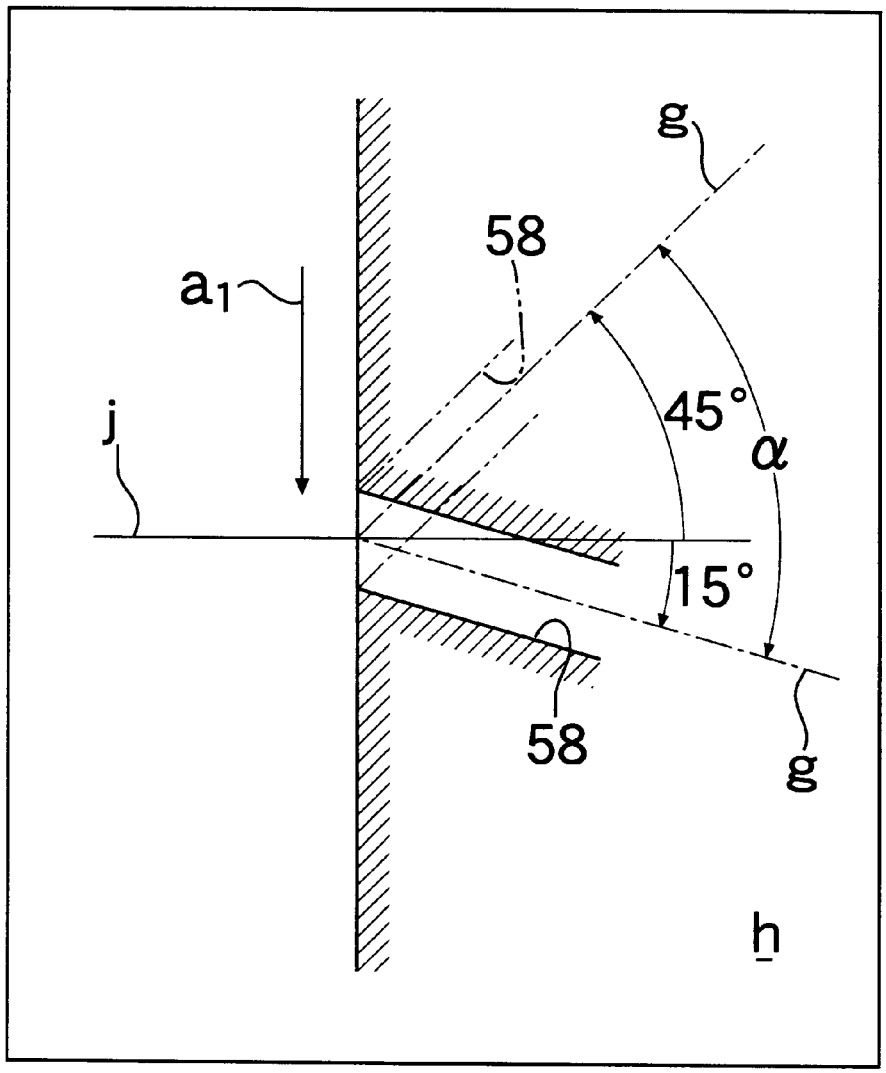
FIG. 20 is a diagram showing the gradient of the discharge port with respect to the ingot-withdrawing direction.

Therefore, the gradient of each of the discharge ports 58 with respect to the ingot withdrawing direction $a_1$ as shown in FIG. 20, namely, the gradient in a vertical plane, is determined in the following manner: When a horizontal line j is drawn in each vertical plane h including the center line g of each discharge port 58, the angle α formed by the center line g with respect to the horizontal line j is determined within a range of 45° upwards from the horizontal line j and 150° downwards from the horizontal line i. This applies to the case where the molten metal m is agitated and the case where the molten metal m is not agitated.

With such arrangement of the discharge port, when the gas generated in the opened end of the discharge port 58 by the vaporization of the lubricating oil enters the lubricating oil supply passageway $F_L$, the gas is discharged smoothly. On the other hand, the gas passed to the molten metal m is discharged outside the water-cooled casting mold 13 along with the ingot I by withdrawing the ingot I. Thus, the ingot I having a good appearance quality and a good internal quality is produced. However, if the angle α exceeds the limit of 45° above the horizontal line j, the internal quality of the ingot I is degraded. On the other hand, if the angle α exceeds the limit of 15° below the horizontal line i, the appearance quality of the ingot I is degraded.

Figure 21:
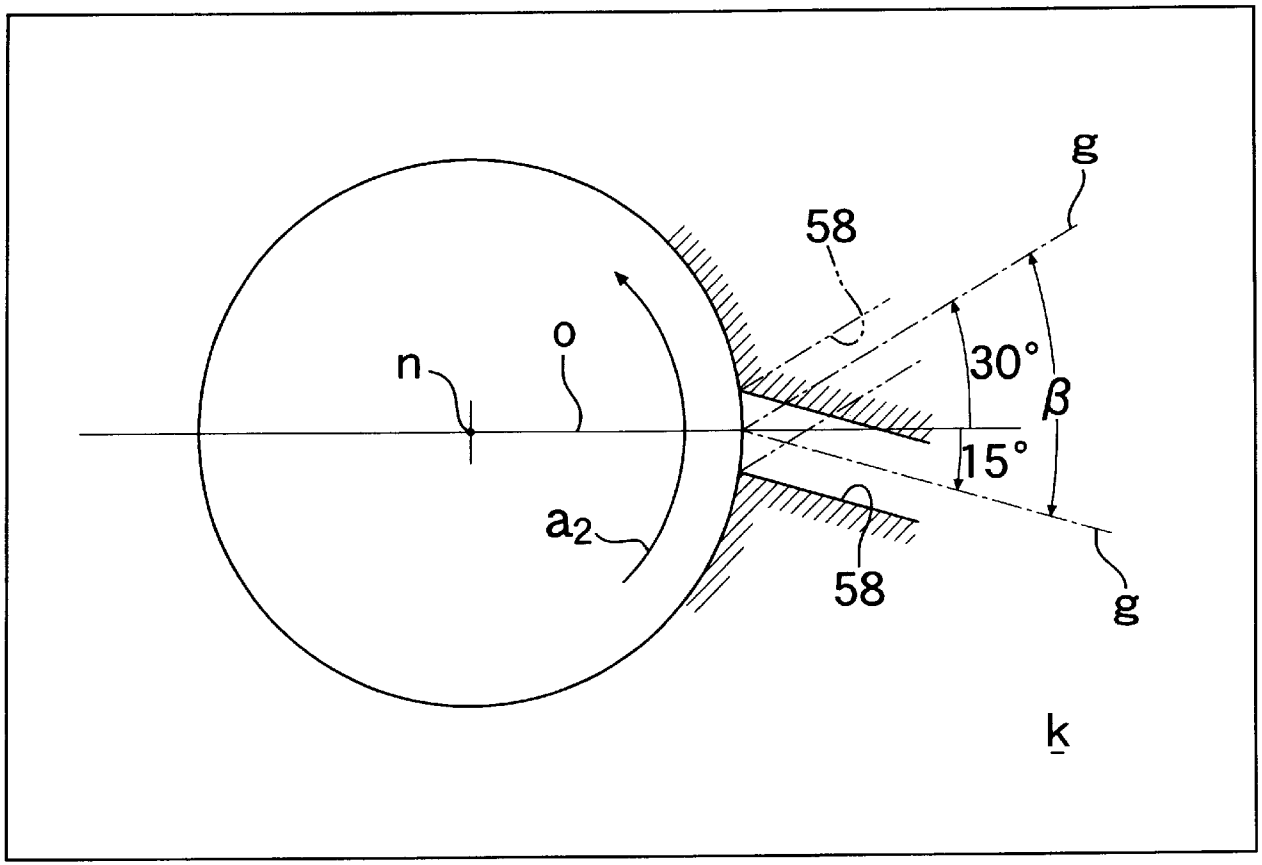
FIG. 21 is a diagram showing the gradient of the discharge port with respect to a direction of rotation of the molten metal.

In the case where the molten metal m is agitated, the gradient of each discharge port 58 in a direction $a_2$ of rotation of the molten metal m as shown in FIG. 21, namely, the gradient in the horizontal plane, is determined in the following manner: When a plurality of reference lines o intersecting the axis n of the cylindrical casting mold 13 in correspondence to the center line of each discharge port 58 are drawn in a horizontal plane k including the center line g of each discharge port 58, as perspectively viewed from above, the angle β formed by each of the center lines q with respect to each of the reference lines o is determined within a range of 30° forwards in the direction $a_2$ of rotation of the molten metal from the reference line o and 15° backwards in the direction $a_2$ of rotation of the molten metal from the reference line o. This is applied to the discharge port 58 in which the center line q is horizontal in the vertical plane h in FIG. 20, and the discharge port 58 in which the center line g has the gradient (α) within the vertical plane h.

With such arrangement, when the gas generated in the opened end of the discharge port 58 by the vaporization of the lubricating oil enters the lubricating oil supply passageway $F_L$, the gas is discharged smoothly. On the other hand, the gas passed to the molten metal m is discharged outside the water-cooled casting mold 13 along with the ingot I by withdrawing the ingot I. Thus, the ingot having a good appearance quality and a good internal quality is produced. However, if the angle β exceeds the limit of 30° forwards in the direction $a_1$ of rotation of the molten metal from the reference line o, the internal quality of the ingot I is degraded. On the other hand, if the angle β exceeds the limit of 15° backwards in the direction a, of rotation of the molten metal from the reference line o the appearance quality of the ingot I is degraded.

What is claimed is:

1. A continuous casting process for continuously casting a light alloy for producing an ingot made of a light alloy by using a continuous casting apparatus comprising a spout having an upward-turned molten metal receiving port and a downward-turned molten metal outlet, a cylindrical water-cooled casting mold which is disposed immediately below said spout, said cylindrical water-cooled casting mold having an inside radius larger than an inside radius of said molten metal outlet, and lubricating oil discharge passages having outlets provided below said spout to supply a lubricating oil through said outlets to a portion between said water-cooled casting mold and the molten metal brought into contact with said water-cooled casting mold, wherein said process comprising the steps of:

preparing said lubricating oil having a vaporization rate of 30% or more at 300° C., supplying said lubricating oil through said outlets of said lubricating oil discharge passages thereby to define an annular gas accumulation below an annular protrusion of said spout for spacing the molten metal apart from said outlets of said lubricating oil discharge passages.

2. A continuous casting process according to claim 1, wherein a lubricating agent mixture of said lubricating oil and a solid lubricating agent is used, an amount A of said solid lubricating agent mixed is in a range of 1% by weight≦A<10% by weight.

3. A continuous casting process according to claim 1 or 2, wherein the dynamic viscosity v of said lubricating oil in inlets of said lubricating oil discharge passages is set at v≦30 $mm^2$/sec.

4. A continuous casting process for continuously casting a light alloy for producing an ingot made of a light alloy by using a continuous casting apparatus comprising a spout having an upward-turned molten metal receiving port and a downward-turned molten metal outlet, a cylindrical water-cooled casting mold which is disposed immediately below said spout, said cylindrical water-cooled casting mold having an inside radius larger than an inside radius of said molten metal outlet, an agitator for applying a circumferential electromagnetic agitating force to the molten metal, and lubricating oil discharge passages having outlets provided below said spout to supply a lubricating oil through said outlets to a portion between said water-cooled casting mold and the molten metal brought into contact with said water-cooled casting mold, wherein said process comprising the steps of:

preparing said lubricating oil having a vaporization rate of 30% or more at 300° C., supplying said lubricating oil through said outlets of said lubricating oil discharge passages thereby to define an annular gas accumulation below an annular protrusion of said spout by vaporization of said lubricating oil for spacing the molten metal apart from outlets of said lubricating oil discharge passages.

5. A continuous casting process according to claim 4, wherein a lubricating agent mixture of said lubricating oil and a solid lubricating agent is used, an amount A of said solid lubricating agent mixed is in a range of 1% by weight≦A<10% by weight.

6. A continuous casting process according to claim 4 or 5, wherein the dynamic viscosity v of said lubricating oil in inlets of said lubricating oil discharge passages is set at v≦30 $mm^2$/sec.

* * * * *